US009755290B2

(12) United States Patent
Xue et al.

(10) Patent No.: US 9,755,290 B2
(45) Date of Patent: Sep. 5, 2017

(54) ELECTROMAGNETIC WAVE MODE TRANSDUCER

(71) Applicant: City University of Hong Kong, Kowloon (HK)

(72) Inventors: Quan Xue, Tai Po (HK); Peng Wu, Kowloon (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 501 days.

(21) Appl. No.: 14/303,832

(22) Filed: Jun. 13, 2014

(65) Prior Publication Data

US 2015/0364803 A1 Dec. 17, 2015

(51) Int. Cl.

| | |
|---|---|
| ***H01P 5/107*** | (2006.01) |
| ***H01P 1/16*** | (2006.01) |
| ***H01P 5/08*** | (2006.01) |
| ***H01P 5/10*** | (2006.01) |

(52) U.S. Cl.

CPC ..... *H01P 5/107* (2013.01); *H01P 1/16* (2013.01); *H01P 5/08* (2013.01); *H01P 5/1022* (2013.01)

(58) Field of Classification Search

CPC .... H01P 1/16; H01P 1/162; H01P 5/10; H01P 5/103; H01P 5/107; H01P 5/1022; H01P 5/08

USPC ..... 333/21 R, 26, 230, 251

See application file for complete search history.

(56) References Cited

U.S. PATENT DOCUMENTS 3,646,481 A * 2/1972 Den ..... H01P 1/16 333/21 R

OTHER PUBLICATIONS

J.F. Xu, Z.N. Chen, X.M. Qing, and W. Hong, "140-GHz TE20-mode dielectric-loaded SIW slot antenna array in LTCC," IEEE Trans. Antennas Propag., 2013, pp. 1784-1793 vol. 61.

J.F. Xu, Z.N. Chen, X.M. Qing, and W. Hong, "A single-layer SIW slot array antenna with TE20 mode," Proceedings of the Asia-Pacific Microwave Conference, 2011, pp. 1330-1333.

H. Uchimura, T. Takenoshita, and M. Fujii, "Development of a 'laminated waveguide'," IEEE Trans. Microw. Theory Tech., 1998, pp. 2438-2443, vol. 46, No. 12.

S. Matsumoto, I. Ohta, K. Fukada, T. Kawai, K. Iio, and T. Kashiwa, "A TEIO-TE20 mode transducer utilizing a ring-angled corner and its application to a compact H-plane out-of-phase power divider," 2009 Asia-Pacific Microwave Conf. Proc., Dec. 2009, pp. 1008-1011.

L. Han and K. Wu, "24-GHz integrated radio and radar system capable of time-agile wireless communication and sensing," IEEE Trans, Microw. Theory Tech., Mar. 2012, pp. 619-631, vol. 60, No. 3.

(Continued)

*Primary Examiner* — Benny Lee

*Assistant Examiner* — Jorge Salazar, Jr.

(74) *Attorney, Agent, or Firm* — Amin, Turocy & Watson, LLP

(57) ABSTRACT

Electromagnetic (EM) mode transition or transducer structures and related devices, techniques, and methods are described. An exemplary EM mode transition or transducer structure can comprise a waveguide cavity section configured to transmit a transverse electric mode 20 ($TE_{20}$) mode of the EM waves. An exemplary EM mode transition can further comprise a fundamental mode rejection section configured to suppress or reflect a transverse electric mode 10 ($TE_{10}$ mode) and a transverse electric mode 30 ($TE_{30}$) mode of the EM waves.

24 Claims, 24 Drawing Sheets

(56) References Cited

OTHER PUBLICATIONS

X.Y. Cheng and Y. K. Yoon, "Hybrid mode radiation in patch antenna loaded with corrugated electric via arrays," 2011 IEEE International Symposium on Antennas and Propagation, 2011, pp. 2080-2082.

J.F. Xu, K. Wu, and X. P. Zhang, "Periodic leaky-wave antenna for millimeter wave applications based on substrate integrated waveguide," IEEE Trans. Antennas Propag., Feb. 2010, pp. 340-347, vol. 58, No. 2.

* cited by examiner

800

1300

1800

2000

2200

ELECTROMAGNETIC WAVE MODE TRANSDUCER

TECHNICAL FIELD

The subject disclosure relates to electromagnetic (EM) wave mode transducers, e.g., to EM wave mode transition or transducer structures, and related devices, techniques, and methods.

BACKGROUND

Microwave and millimeter wave circuits (e.g., such as those associated with wideband planar baluns, filters, and antenna systems, etc.) and associated systems (e.g., wireless communication systems, etc.) can employ waveguides such as substrate integrated waveguides (SIWs), laminated waveguides, or post-wall waveguides, which can be considered as waveguides integrated in substrates. Conventional SIWs have been demonstrated in the various applications of filters, power combiners and dividers, couplers, antennas, and so on. However, transitions or transducers between SIWs and other transmission lines require particular performance and design considerations as well as component integration considerations.

In addition, conventional wideband transitions or transducers from planar transmission lines to SIW are typically designed for the dominant mode of SIW, namely, the transverse electric mode 10 ($TE_{10}$ mode). However, as SIW deployment in electronic systems increases, higher order mode (e.g., transverse electric mode 20 ($TE_{20}$ mode), etc.) components associated with SIWs have become the subject of increasing research. For instance, conventional higher order mode SIW components for antenna systems operating in millimeter wave bands have been proposed.

However, limitations of various conventional transition or transducer structures or feeding technologies exist. For example, conventional transition or transducer structures for higher order mode SIW components are complex, thereby increasing fabrication costs, the bandwidth of conventional transition or transducer structures is relatively narrow, and so on. Accordingly, improvements that provide a wideband direct transition or transducer to higher order mode waveguides should simplify the transition or transducer structures, with associated reductions in fabrication cost, and should enhance performance stability of the transition or transducer structures by incorporating relaxed fabrication tolerances.

The subject disclosure provides embodiments that improve upon these and other deficiencies. The above-described deficiencies of conventional transition or transducer structures for higher order mode waveguide components are merely intended to provide an overview of some of the problems of conventional implementations, and are not intended to be exhaustive. Other problems with conventional implementations and techniques and corresponding benefits of the various non-limiting embodiments described herein may become further apparent upon review of the following description.

SUMMARY

The following presents a simplified summary of the specification to provide a basic understanding of some aspects of the specification. This summary is not an extensive overview of the specification. It is intended to neither identify key or critical elements of the specification nor delineate any scope particular to any embodiments of the specification, or any scope of the claims. Its sole purpose is to present some concepts of the specification in a simplified form as a prelude to the more detailed description that is presented later.

In various non-limiting embodiments of the subject disclosure, EM wave mode transition or transducer structures, and related devices, techniques, and methods are provided. For instance, non-limiting implementations provide exemplary devices comprising an EM mode transducer configured as an EM mode transition between a fundamental mode transmission line and a $TE_{20}$ mode waveguide. As a non-limiting example, various implementations of the exemplary devices can comprise a cavity section, such as an over-moded waveguide cavity section, configured to propagate or excite more than one mode of EM waves over a selected operation frequency band, such as the X-band, or portions thereof. In further non-limiting examples, exemplary devices can comprise a fundamental mode rejection section of the EM mode transducer.

Additionally, in various embodiments of the subject disclosure, exemplary apparatuses can comprise means for transmitting or receiving EM waves to or from a fundamental mode transmission line, means for suppressing a transverse electric mode 30 ($TE_{30}$ mode) of the EM waves, means for reflecting or suppressing a $TE_{10}$ mode of the EM waves, and means for controlling propagation of a $TE_{20}$ mode of the EM waves from the fundamental mode transmission line.

In other non-limiting implementations, exemplary methods associated with various non-limiting embodiments of EM wave mode transition or transducer structures and related devices are provided.

These and other embodiments are described in more detail below.

BRIEF DESCRIPTION OF THE DRAWINGS

Various non-limiting embodiments are further described with reference to the accompanying drawings in which.

DETAILED DESCRIPTION

Overview

Figure 1:
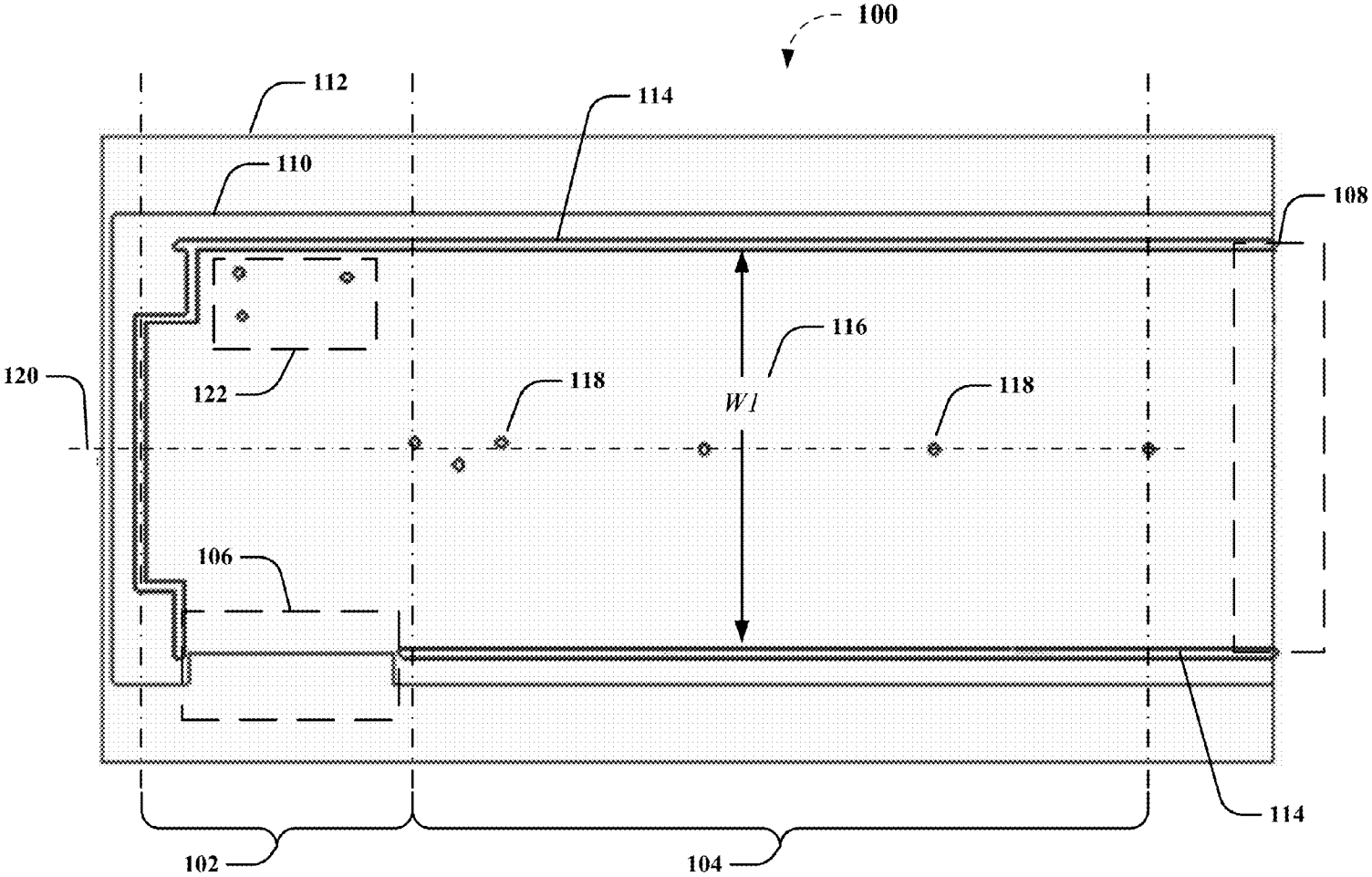
FIG. 1 depicts a top view of an exemplary electromagnetic (EM) mode transition or transducer structure, according to non-limiting aspects of the subject disclosure.

While a brief overview is provided, certain aspects of the subject disclosure are described or depicted herein for the purposes of illustration and not limitation. Thus, variations of the disclosed embodiments as suggested by the disclosed apparatuses, systems and methodologies are intended to be encompassed within the scope of the subject matter disclosed herein. For example, the various embodiments of the apparatuses, techniques and methods of the subject disclosure are described in the context of EM mode transducer or transition structures. However, as further detailed below, various exemplary implementations can be applied to other areas associated with waveguides, without departing from the subject matter described herein. Furthermore, while various embodiments of the subject disclosure may be described in the context of a particular direction of wave propagation, it is to be appreciated that, as passive devices, the opposite direction of wave propagation is also possible without deviating from the scope of the described embodiments. As a non-limiting example, where EM waves are described as propagating from a fundamental mode transmission line to a $TE_{20}$ mode waveguide, it is to be appreciated that EM waves can also be propagated from the $TE_{20}$ mode waveguide to the fundamental mode transmission line using the described embodiments.

As used herein, the term, "over-moded," in reference to a waveguide, a component related thereto, or portion thereof, can refer to a component, or portion thereof, that can be configured to propagate or excite more than one mode of EM waves over a selected or predetermined operation frequency band. As further used herein, the terms "substrate integrated waveguide (SIW)", "laminated waveguides," or "post-wall waveguides," can refer to waveguides integrated in substrates, according to conventional integration and/or fabrication techniques.

As described in the background, as SIW deployment in electronic systems increases, higher order mode (e.g., $TE_{20}$ mode, etc.) components associated with SIWs have become the subject of increasing research. For instance, conventional higher order mode SIW components for antenna systems operating in millimeter wave bands have been proposed. However, conventional transition or transducer structures for higher order mode SIW components are complex, thereby increasing fabrication costs, the bandwidth of conventional transition or transducer structures is relatively narrow, and so on. Accordingly, improvements to conventional transition or transducer structures for higher order mode SIW components as described herein can provide a wideband direct transition or transducer for higher order mode waveguides.

For instance, practical wideband planar higher order EM mode transition or transducer structures, as described herein, can be employed in wideband EM mode transitions between a fundamental mode transmission line and a higher order mode (e.g., $TE_{20}$ mode, etc.) waveguide. According to non-limiting embodiments of the subject disclosure, exemplary EM mode transition or transducer structures can comprise a waveguide cavity section (e.g., an over-moded waveguide cavity section, etc.). In further non-limiting embodiments, exemplary EM mode transition or transducer structures can further comprise a fundamental mode rejection section.

According to various non-limiting aspects, exemplary embodiments, as described herein, can simplify EM mode transition or transducer structures, with associated reductions in fabrication cost. In addition, according to further aspects of the subject disclosure, various embodiments as described herein can enhance performance stability of exemplary EM mode transition or transducer structures by incorporating various non-limiting aspects that can be resilient to variations in fabrication processes. In addition, various aspects of the exemplary EM mode transition or transducer structures, as described herein, can be employed in substrate integrated circuits, metal waveguide devices, and so on.

In contrast to typical $TE_{20}$ EM mode transition or transducer structures based on conventional multilayer technologies or defected ground metal structures, various aspects of exemplary EM mode transition or transducer structures, as described herein, can comprise a planar structure without employing defecting ground metal structures. As a result, exemplary EM mode transition or transducer structures, as described herein, can provide convenient methods of integration or fabrication in associated apparatuses or articles of manufacture. Moreover, as compared with conventional technologies for waveguide direct feeding, exemplary EM mode transition or transducer structures, as described herein, can facilitate providing wider bandwidth EM mode transition or transducer structures, can facilitate impedance matching, and can facilitate fundamental mode rejection of EM waves. In addition, various aspects of the exemplary EM mode transition or transducer structures, as described herein, can be employed in substrate integrated circuits, metal waveguide devices, and so on.

According to further non-limiting aspects, exemplary EM mode transition or transducer structures, as described herein, can facilitate directly feeding an associated $TE_{20}$ mode waveguide by a microstrip line, a waveguide, a coplanar waveguide (CPW), and so on, as further described herein. For instance, as exemplified herein, exemplary EM mode transition or transducer structures to a $TE_{20}$ mode substrate integrated waveguide from microstrip line, SIW, and CPW can facilitate wideband planar baluns, filters, and antenna feeding networks.

Various aspects or features of the subject disclosure are described with reference to the drawings, wherein like reference numerals are used to refer to like elements throughout. In this specification, numerous specific details are set forth in order to provide a thorough understanding of the subject disclosure. It should be understood, however, that the certain aspects of disclosure may be practiced without these specific details, or with other methods, components, parameters, etc. In other instances, well-known structures and devices can be shown in block diagram form to facilitate description and illustration of the various embodiments. In accordance with one or more embodiments described in subject disclosure, exemplary EM mode transition or transducer structures, and related devices, techniques, and methods are provided.

While, for the purposes of illustration, and not limitation, various non-limiting implementations of the subject disclosure are described herein in reference to EM mode transition or transducer structures and so on, it can be understood that variations of the subject disclosure are possible within the scope of claims appended to the subject matter disclosed herein. Thus, it can be understood that particular aspects of exemplary EM mode transition or transducer structures and so on, as described herein, can be employed or be desirable in conjunction with particular circuits, systems, components, and/or combination, variations and/or portions thereof, associated with the subject disclosure, depending on, for example, design considerations, etc. For instance, particular non-limiting aspects of exemplary EM mode transition or transducer structures, as described in reference to FIGS. 1-6, for example, can provide an EM mode transition between a fundamental mode transmission line and a $TE_{20}$ mode waveguide.

Exemplary Embodiments

Figure 2:
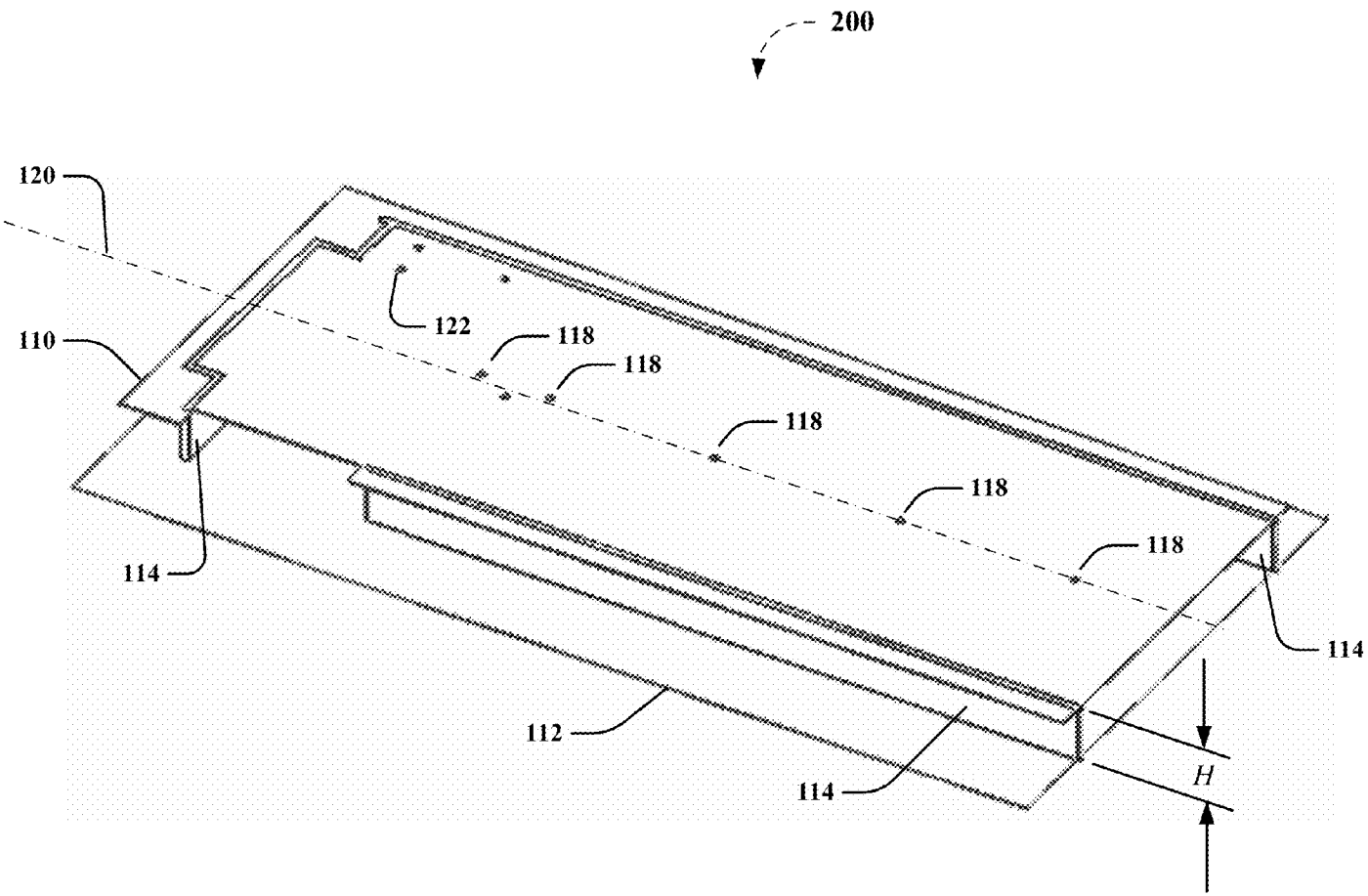
FIG. 2 depicts a three-dimensional view of an exemplary EM mode transition or transducer structure, according to further aspects of the subject disclosure.
Figure 3:
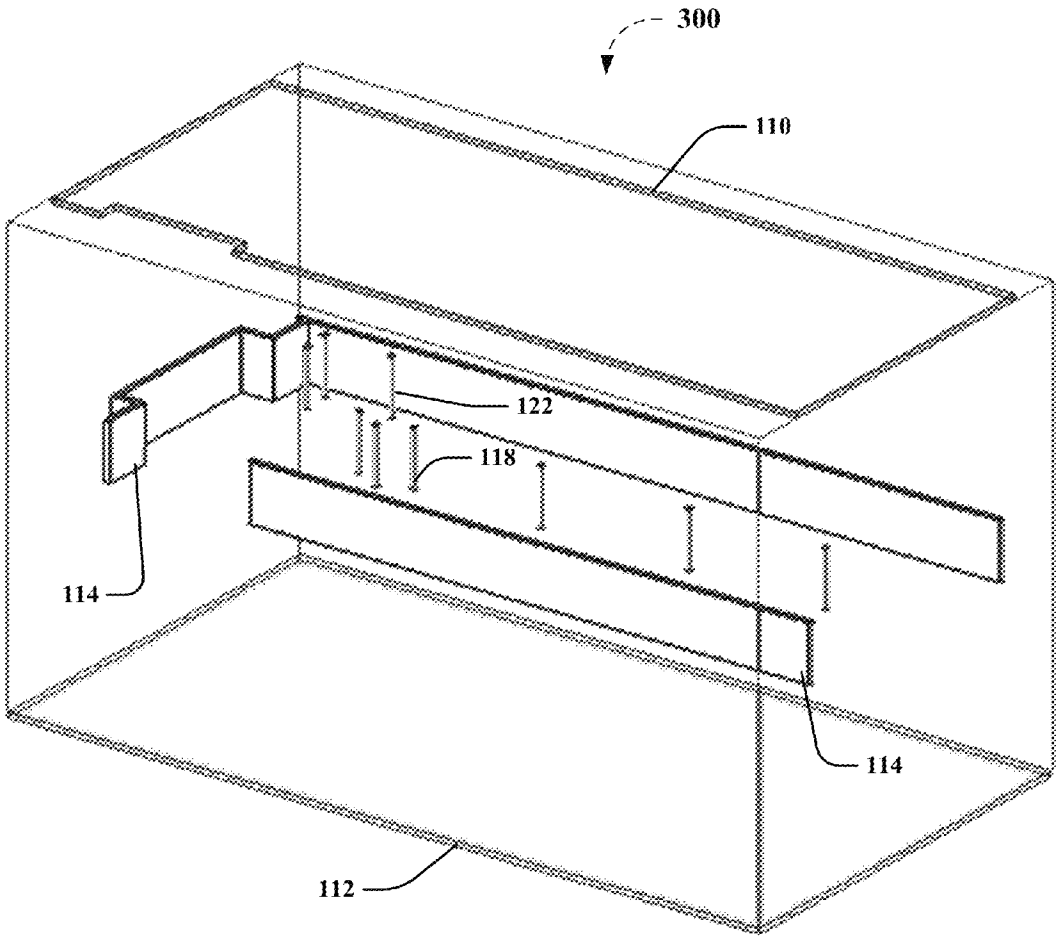
FIG. 3 depicts another three-dimensional view of an exemplary EM mode transition or transducer structure.

Accordingly, FIG. 1 depicts a top view of an exemplary EM mode transition or transducer structure 100, according to non-limiting aspects of the subject disclosure. FIG. 2 depicts a three-dimensional view 200 of an exemplary EM mode transition or transducer structure 100, according to further aspects of the subject disclosure, whereas FIG. 3 depicts another three-dimensional view 300 of an exemplary EM mode transition or transducer structure 100. According to non-limiting embodiments of the subject disclosure, exemplary EM mode transition or transducer structure 100 can comprise a waveguide cavity section 102 (e.g., an over-moded waveguide cavity section 102, etc.). In further non-limiting embodiments, exemplary EM mode transition or transducer structure 100 can further comprise a fundamental mode rejection section 104.

In addition, exemplary EM mode transition or transducer structure 100 can further comprise a first port 106 that connects a fundamental mode transmission line (not shown) to the a waveguide cavity section 102 (e.g., an over-moded waveguide cavity section 102, etc.) of the exemplary EM mode transition or transducer structure 100. In further non-limiting aspects, exemplary EM mode transition or transducer structure 100 can also comprise a second port 108 located proximate to the fundamental mode rejection section 104 and opposite the waveguide cavity section 102 (e.g., an over-moded waveguide cavity section 102, etc.). In various non-limiting aspects, first port 106 can connect a fundamental mode transmission line (not shown) comprising a microstrip transmission line, a strip line, a waveguide, a CPW, and the like, as further described herein. According to further non-limiting aspects, the second port 108 can be configured to propagate a $TE_{20}$ mode of EM waves to a $TE_{20}$ mode waveguide (not shown) connected at the second port 108.

In various non-limiting implementations, exemplary EM mode transition or transducer structure 100 can comprise a top substrate sheet 110 and a bottom substrate sheet 112 comprising a metallic substance. Thus, top substrate sheet 110 and bottom substrate sheet 112 can comprise a top substrate metal sheet 110 and a bottom substrate metal sheet 112, as further described herein. In further non-limiting implementations, EM mode transition or transducer structure 100 can further comprise a set of metallic sidewalls 114 (e.g., narrow metallic sidewalls 114, etc.) that can support top substrate metal sheet 110 and bottom substrate metal sheet 112. In still further non-limiting implementations, EM mode transition or transducer structure 100 can comprise a set of metallic sidewall posts that can support top substrate metal sheet 110 and bottom substrate metal sheet 112, as further described herein.

According to a non-limiting aspect, width W1 116 of a fundamental mode rejection section (e.g., fundamental mode rejection section 104, etc.) of the exemplary EM mode transition or transducer structure 100 can be selected (and a fundamental mode rejection section 104 configured thereby) among a range of widths W1 116 of a fundamental mode rejection section 104 that can facilitate cutting off $TE_{30}$ modes in a selected operation frequency band, thereby allowing transmission of the $TE_{20}$ mode of EM waves while suppressing the $TE_{30}$ mode. Accordingly, a fundamental mode rejection section 104 of exemplary EM mode transition or transducer structure 100 can be configured for $TE_{20}$ mode transmission and $TE_{30}$ mode suppression. For instance, a waveguide cut off frequency, for a general $TE_{n0}$ mode, when the EM wave frequency is lower than the waveguide cut off frequency, the EM wave will propagate in the waveguide. Thus, by selecting waveguide width (e.g., width of W1 116) for a particular $TE_{n0}$ mode to be smaller than the cut off waveguide width of a $TE_{30}$ mode, $TE_{30}$ mode of the EM wave will not be propagated in the waveguide having a width of W1 116.

Accordingly, as a non-limiting example, W1 116 selected for fundamental mode rejection section 104 can be larger than a width value that can be determined to cut off $TE_{20}$ mode of the lowest frequency in a selected operation frequency band, such as, for example, the X band (e.g., EM waves having a frequency range of about 7 GHz to about 11.2 GHz, etc.), or a subset thereof, for exemplary EM mode transition or transducer structure 100, but less than a width value that can be determined to cut off $TE_{30}$ mode in the selected operation frequency band. Thus, in a particular non-limiting implementation of the subject disclosure, an exemplary EM mode transition or transducer structure 100 can provide a wideband EM mode transition or transducer structure 100 comprising a fundamental mode rejection section 104, according to considerations of multiple frequencies of the $TE_{201}$ mode resonance.

In further non-limiting aspects, exemplary EM mode transition or transducer structure 100 can further comprise an array of metallic posts 118 located proximate to a centerline 120 of the fundamental mode rejection section 104. As a non-limiting example, an array of cylindrical metallic posts 118 array can be oriented in a longitudinal direction of exemplary EM mode transition or transducer structure 100. In a further non-limiting example, metallic posts 118 can be configured to traverse the distance between top substrate metal sheet 110 and a bottom substrate metal sheet 112, as depicted in FIGS. 1-3, and as further described herein. Accordingly, metallic posts 118 located proximate to a centerline 120 of the fundamental mode rejection section 104 can facilitate suppressing the fundamental mode of EM waves in the fundamental mode rejection section 104 of exemplary EM mode transition or transducer structure 100. In addition, an array of metallic posts (e.g., an array of metallic posts 118, etc.) located proximate to a centerline 120 of the fundamental mode rejection section (e.g., fundamental mode rejection section 104, etc.) can facilitate suppressing the $TE_{30}$ mode. In further non-limiting aspects, metallic posts 118 can comprise metallic posts having a cross section other than a cylindrical cross section, for example, such as elliptic, square, triangular, rectangular, pentagonal, hexagonal, and so on, without limitation. In yet another non-limiting aspect, the distance between any two neighboring metallic posts 118 in the fundamental mode rejection section 104 can be configured to be less than one guided wavelength. In still further non-limiting aspects, a waveguide cavity section 102 (e.g., an over-moded waveguide cavity section 102, etc.) of exemplary EM mode transition or transducer structure 100 can further comprise a set of impedance matching metallic posts 122, as further described herein.

As a result, according to various non-limiting embodiments of the subject disclosure, when an EM field in the selected operation frequency band is incident to exemplary EM mode transition or transducer structure 100 from the first port 106, $TE_{20}$ and $TE_{10}$ modes can be excited in a waveguide cavity section 102 (e.g., an over-moded waveguide cavity section 102, etc.). In addition, according to various aspects, a fundamental mode, e.g., $TE_{10}$ mode, can be reflected back and/or suppressed by the metallic posts 118 in fundamental mode rejection section 104. As a result, the symmetrical plane of exemplary EM mode transition or transducer structure 100 in a transition to a $TE_{20}$ mode waveguide (not shown) can be considered as an electric wall, such that cylindrical metallic posts 118 in the rejection section have few impacts on the $TE_{20}$ mode transmission. Thus, when the EM field is transmitted to the second port 108, only $TE_{20}$ mode exists, for example, as further described herein.

As a result, exemplary EM mode transition or transducer structure 100 can provide wideband EM wave mode transition between fundamental mode transmission line (not shown) and $TE_{20}$ mode waveguide (not shown). As further described above, exemplary EM mode transition or transducer structure 100 can directly feed a $TE_{20}$ mode waveguide from a microstrip transmission line, a strip line, a waveguide, a CPW, and so on, which can be employed in any of a number of applications involving microwave and/or millimeter wave higher order mode substrate integrated circuits, metal waveguide devices, and so on, such as planar baluns, filters, and antenna feeding networks.

Figure 4:
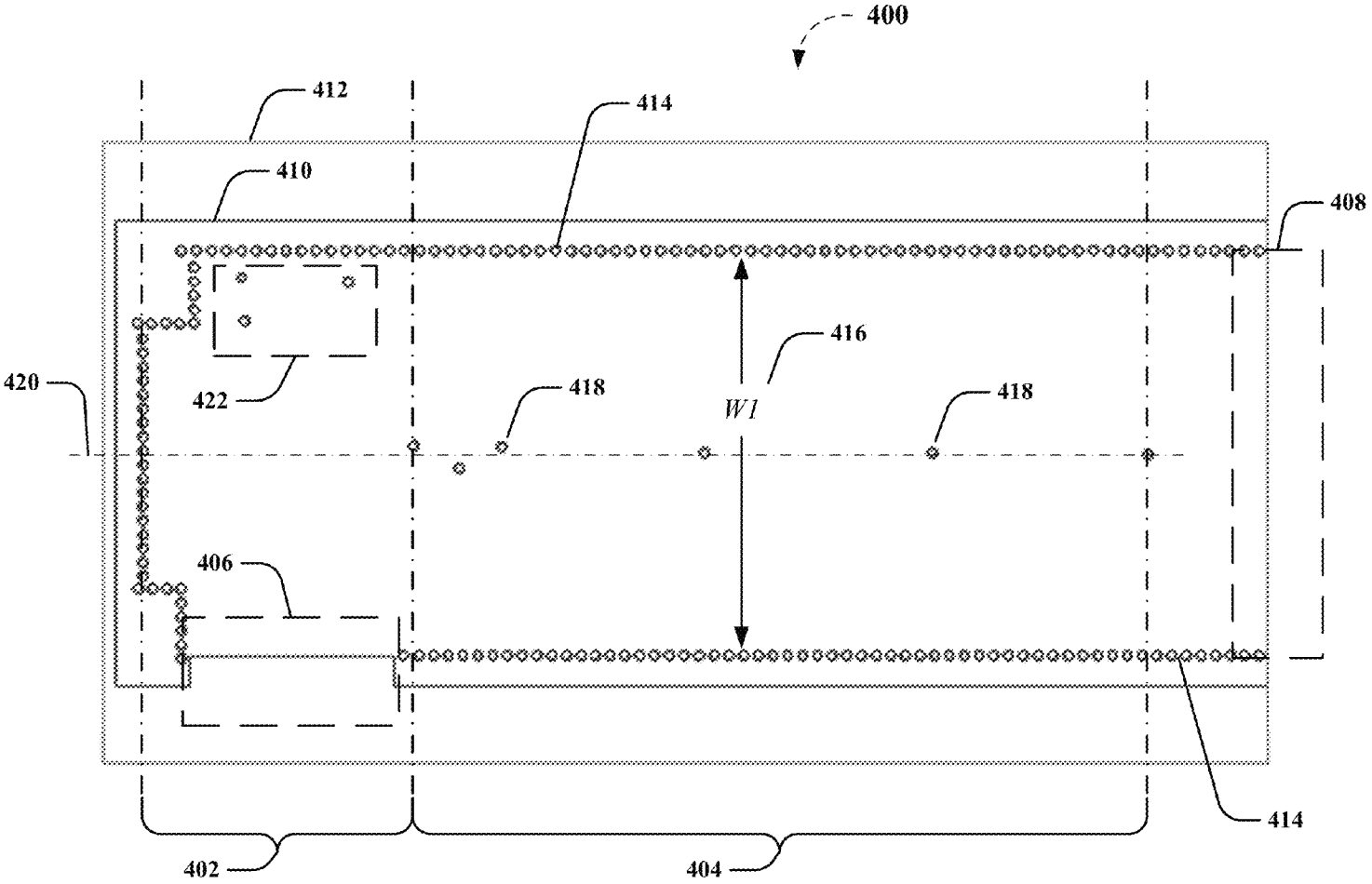
FIG. 4 depicts a top view of another exemplary EM mode transition or transducer structure, according to further non-limiting aspects.
Figure 5:
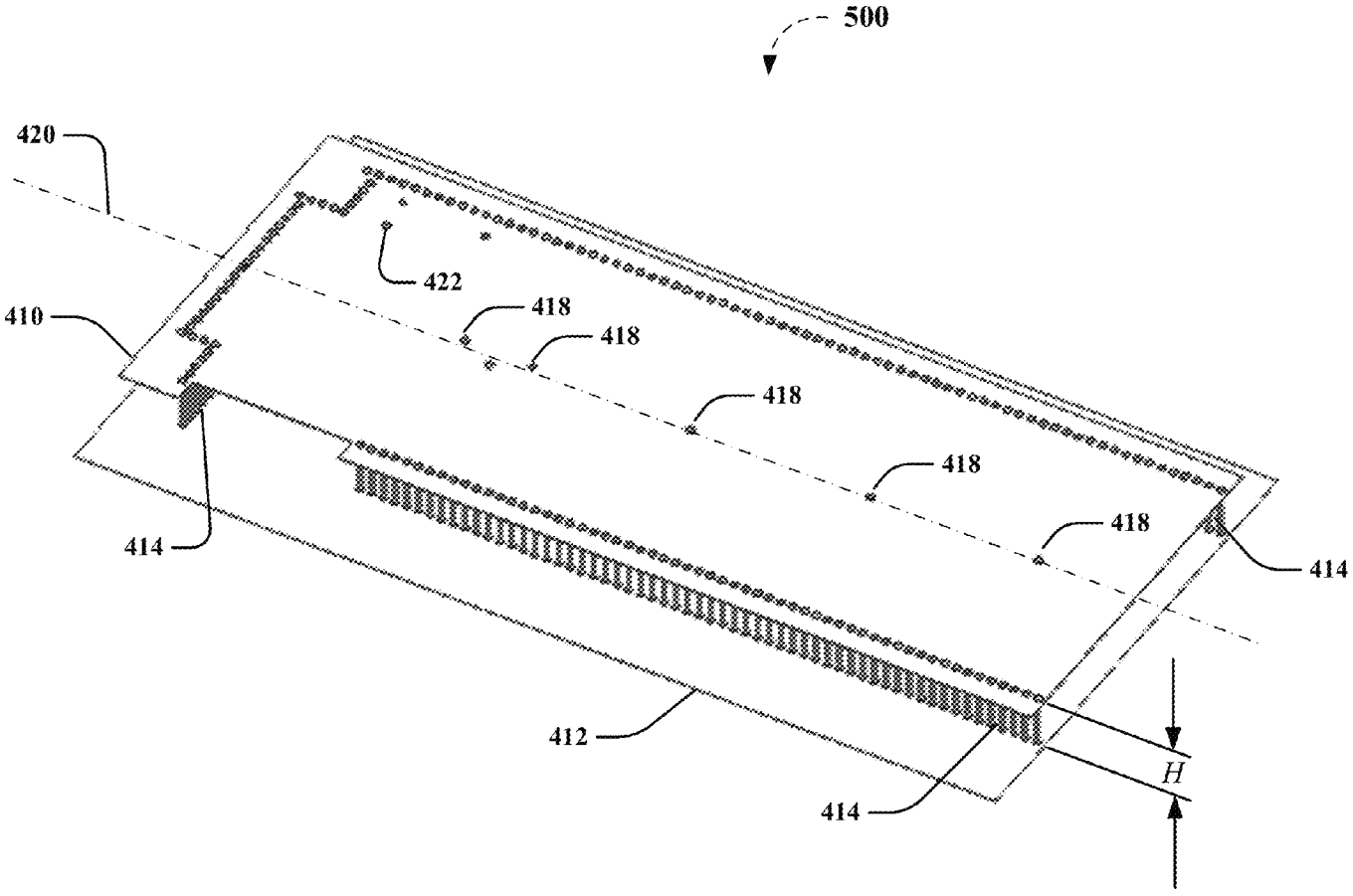
FIG. 5 depicts a three-dimensional view of an exemplary EM mode transition or transducer structure, according to further aspects of the subject disclosure.
Figure 6:
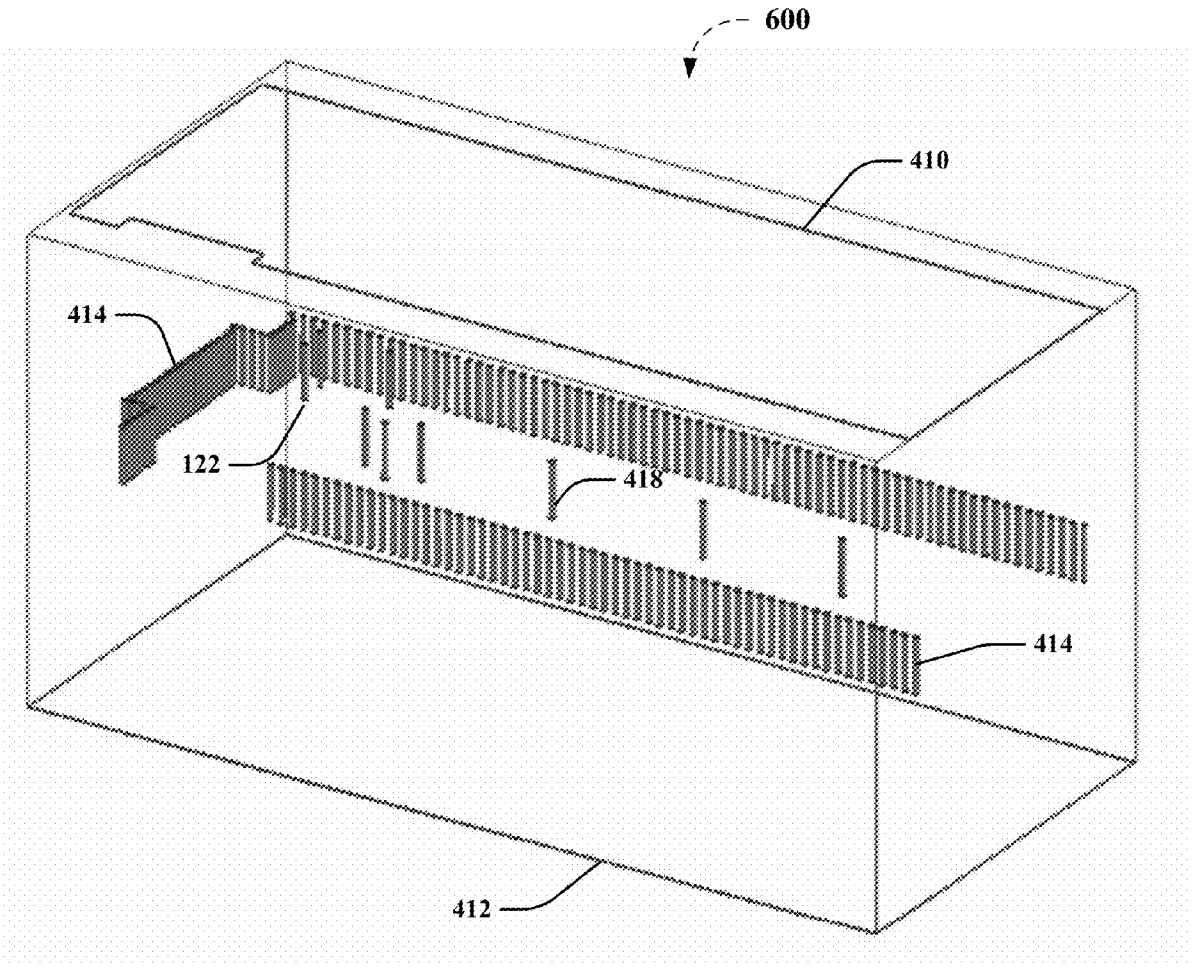
FIG. 6 depicts another three-dimensional view of an exemplary EM mode transition or transducer structure.

FIG. 4 depicts a top view of another exemplary EM mode transition or transducer structure 400, according to further non-limiting aspects. FIG. 5 depicts a three-dimensional view of an exemplary EM mode transition or transducer structure 400, according to further aspects of the subject disclosure, whereas FIG. 6 depicts another three-dimensional view of an exemplary EM mode transition or transducer structure 400. According to non-limiting embodiments of the subject disclosure, exemplary EM mode transition or transducer structure 400 can comprise a waveguide cavity section 402 (e.g., an over-moded waveguide cavity section 402, etc.). In further non-limiting embodiments, exemplary EM mode transition or transducer structure 400 can further comprise a fundamental mode rejection section 404. In addition, exemplary EM mode transition or transducer structure 400 can further comprise a first port 406 that connects a fundamental mode transmission line (not shown) to the a waveguide cavity section 402 (e.g., an over-moded waveguide cavity section 402, etc.) of the exemplary EM mode transition or transducer structure 400.

In further non-limiting aspects, exemplary EM mode transition or transducer structure 400 can also comprise a second port 408 located proximate to the fundamental mode rejection section 404 and opposite the waveguide cavity section 402 (e.g., an over-moded waveguide cavity section 402, etc.). In various non-limiting aspects, first port 406 can connect a fundamental mode transmission line (not shown) comprising a microstrip transmission line, a strip line, a waveguide, a CPW, and the like, as further described herein. According to further non-limiting aspects, the second port 408 can be configured to propagate a $TE_{20}$ mode of EM waves to a $TE_{20}$ mode waveguide (not shown) connected at the second port 408.

As further described above, exemplary EM mode transition or transducer structure 400 can comprise a top substrate sheet 410 and a bottom substrate sheet 412 comprising a metallic substance, such as a top substrate metal sheet 410 and a bottom substrate metal sheet 412, for example, regarding FIGS. 1-3. In further non-limiting implementations, EM mode transition or transducer structure 400 can further comprise a set of metallic sidewalls (e.g., narrow metallic sidewalls, etc.) that can support top substrate metal sheet 410 and bottom substrate metal sheet 412, for example, as described above, regarding FIG. 1. In other non-limiting implementations, EM mode transition or transducer structure 400 can comprise a set of sidewall posts 414 (e.g., metallic sidewall posts 414) that can support top substrate metal sheet 410 and bottom substrate metal sheet 412, as further described herein. In addition, as described above, width W1 416 of the fundamental mode rejection section 404 of the exemplary EM mode transition or transducer structure 400 can be selected (and fundamental mode rejection section 404 configured thereby) among a range of widths W1 416 of fundamental mode rejection section 404 that can facilitate cutting off $TE_{30}$ modes in the selected operation frequency band, thereby allowing transmission of the $TE_{20}$ mode of EM waves while suppressing the $TE_{30}$ mode.

Accordingly, fundamental mode rejection section 404 of exemplary EM mode transition or transducer structure 400 can be configured for $TE_{20}$ mode transmission and $TE_{30}$ mode suppression. As a non-limiting example, W1 416 selected for the fundamental mode rejection section 404 can be larger than a width value that can be determined to cut off $TE_{20}$ mode of the lowest frequency in a selected operation frequency band, such as, for example, the X band (e.g., EM waves having a frequency range of about 7 GHz to about 11.2 GHz, etc.), or a subset thereof, for exemplary EM mode transition or transducer structure 400, but less than a width value that can be determined to cut off $TE_{30}$ mode in the selected operation frequency band. Accordingly, as described above, in a particular non-limiting implementation of the subject disclosure, an exemplary EM mode transition or transducer structure 400 can provide a wideband EM mode transition or transducer structure 400 comprising fundamental mode rejection section 404, according to considerations of multiple frequencies of the $TE_{201}$ mode resonance.

In further non-limiting aspects, exemplary EM mode transition or transducer structure 400 can further comprise an array of metallic posts 418 located proximate to a centerline 420 of the fundamental mode rejection section 404. As a non-limiting example, an array of cylindrical metallic posts 418 array can be oriented in a longitudinal direction of exemplary EM mode transition or transducer structure 400. In a further non-limiting example, metallic posts 418 can be configured to traverse the distance between top substrate metal sheet 410 and a bottom substrate metal sheet 412, as depicted in FIGS. 4-6, and as further described herein. Accordingly, metallic posts 418 located proximate to a centerline 420 of the fundamental mode rejection section 404 can facilitate reflecting and/or suppressing the fundamental mode of EM waves in the fundamental mode rejection section 404 of exemplary EM mode transition or transducer structure 400. In addition, an array of metallic posts (e.g., an array of metallic posts 418, etc.) located proximate to a centerline 420 of the fundamental mode rejection section (e.g., fundamental mode rejection section 404, etc.) can facilitate suppressing the $TE_{30}$ mode. In further non-limiting aspects, metallic posts 418 can comprise metallic posts having a cross section other than a cylindrical cross section, for example, such as elliptic, square, triangular, rectangular, pentagonal, hexagonal, and so on, without limitation. As further described herein, the distance between any two neighboring metallic posts 418 in the fundamental mode rejection section 404 can be configured to be less than one guided wavelength. In still further non-limiting aspects, waveguide cavity section 402 (e.g., an over-moded waveguide cavity section 402, etc.) of exemplary EM mode transition or transducer structure 400 can further comprise a set of impedance matching metallic posts 422, as an example.

Accordingly, as described above, when an EM field in the selected operation frequency band is incident to exemplary EM mode transition or transducer structure 400 from the first port 406, $TE_{20}$ and $TE_{10}$ modes can be excited in waveguide cavity section 402 (e.g., an over-moded waveguide cavity section 402, etc.). In addition, according to various aspects, fundamental $TE_{10}$ mode can be reflected back and suppressed by the metallic posts 418 in fundamental mode rejection section 404. As a result, the symmetrical plane of exemplary EM mode transition or transducer structure 400 in a transition to a $TE_{20}$ mode waveguide (not shown) can be considered as an electric wall, such that cylindrical metallic posts 418 in the rejection section have few impacts on the $TE_{20}$ mode transmission. Thus, when the EM field is transmitted to the second port 408, only $TE_{20}$ mode exists, for example, as further described herein.

As further described above, exemplary EM mode transition or transducer structure 400 can provide wideband EM wave mode transition between fundamental mode transmission line (not shown) and $TE_{20}$ mode waveguide (not shown). For instance, exemplary EM mode transition or transducer structure 400 can directly feed a $TE_{20}$ mode waveguide from a microstrip transmission line, a strip line, a waveguide, a CPW, and so on, which can be employed in any of a number of applications involving microwave and/or millimeter wave higher order mode substrate integrated circuits, metal waveguide devices, and so on, such as planar baluns, filters, and antenna feeding networks, for example, as further described above regarding FIGS. 1-3.

Figure 7:
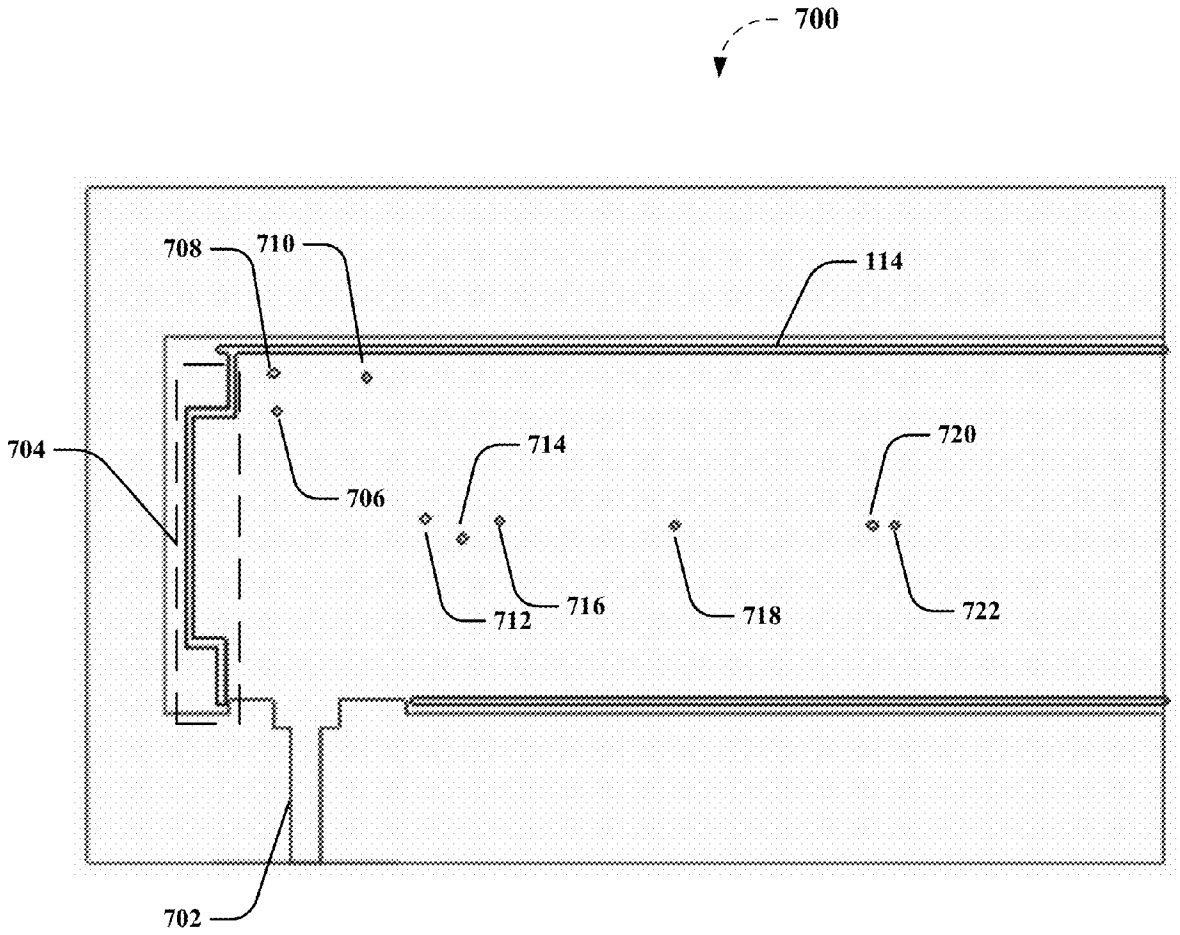
FIG. 7 depicts a top view of further exemplary EM mode transition or transducer structure, according to still further non-limiting aspects.

FIG. 7 depicts a top view of further exemplary EM mode transition or transducer structure 700, according to still further non-limiting aspects. As a particular non-limiting example, exemplary EM mode transition or transducer structure 700 can comprise an exemplary EM mode transition or transducer structure 100 configured as an EM mode transition between a fundamental mode transmission line comprising a microstrip transmission line (Qusi-TEM) 702 and a $TE_{20}$ mode waveguide (not shown), such as a laminated $TE_{20}$ mode waveguide, for example, in a selected operation frequency band, such as, for example, the X band (e.g., EM waves having a frequency range of about 7 GHz to about 11.2 GHz, etc.), or a subset thereof. In particular non-limiting embodiments of the subject disclosure, an exemplary EM mode transition or transducer structure 700 can be fabricated on a Rogers RT/Duroid® 5870 dielectric substrate that has a relative dielectric constant of 2.33, a thickness of 0.785 mm, and a dielectric loss tangent of 0.0012.

In a further non-limiting aspect, exemplary EM mode transition or transducer structure 700 comprising metallic sidewalls 114 of the a waveguide cavity section 102 (e.g., an over-moded waveguide cavity section 102, etc.) can be formed by rectangular metallic slots through the substrate (not shown) with wide walls of the waveguide formed by top substrate metal sheet 110 and bottom substrate metal sheet 112. The waveguide width W1 116 of 27.4 millimeters (mm) can be selected (and a fundamental mode rejection section 404 configured thereby) to suppress the $TE_{30}$ transmission mode in the selected operation frequency band. Step-shaped side wall 704 can be configured to facilitate transmission of the multiple $TE_{20}$ modes and to facilitate improved transition bandwidth associated with a waveguide cavity section 102 (e.g., an over-moded waveguide cavity section 102, etc.) of exemplary EM mode transition or transducer structure 700. As further described above, exemplary EM mode transition or transducer structure 700 can further comprise a set of impedance matching metallic posts 122 (e.g., metallic posts 706, 708, and 710) in a waveguide cavity section 102 (e.g., an over-moded waveguide cavity section 102, etc.) can be configured to facilitate impedance matching.

In a further non-limiting aspect of the subject disclosure, exemplary EM mode transition or transducer structure 700 can further comprise can comprise a set of vias (e.g., set of vias 712, 714, 716, 718, 720, and 722, etc.) in the substrate (not shown) that can be configured to reflect back and/or suppress the $TE_{10}$ mode electromagnetic field in fundamental mode rejection section 104. As further described herein, by adjusting the positions and/or dimensions of impedance matching metallic posts 122 and the waveguide width W1 116 of a waveguide cavity section 102 (e.g., an over-moded waveguide cavity section 102, etc.), exemplary EM mode transition or transducer structure 700 can be configured as an EM mode transition between a fundamental mode transmission line comprising a microstrip line 702 and a $TE_{20}$ mode waveguide (not shown), such as a laminated $TE_{20}$ mode waveguide, with broad matching bandwidth and high fundamental mode suppression, for example, as demonstrated herein, regarding FIGS. 8-11.

Figure 8:
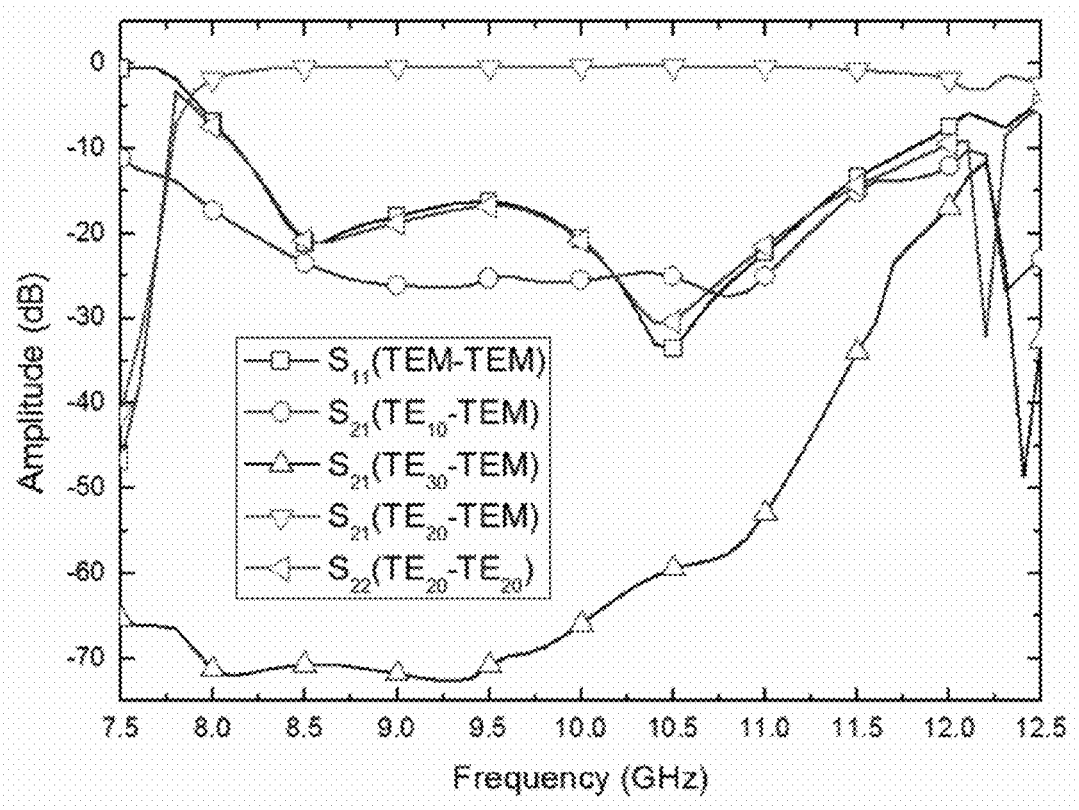
FIG. 8 demonstrates non-limiting aspects of transition performance for an exemplary EM mode transition or transducer structure of FIG. 7.

For instance, FIG. 8 demonstrates non-limiting aspects of transition performance 800 for an exemplary EM mode transition or transducer structure 700 of FIG. 7. For example, FIG. 8 demonstrates that exemplary EM mode transition or transducer structure 700, as described herein, has wide bandwidth. In addition, reflection coefficient $S_{11}$ (TEM-TEM) is better than 16.2 decibel (dB), the transition coefficient $S_{21}$ ($TE_{20}$-TEM) is better than 0.62 dB, and the $TE_{10}$ and $TE_{30}$ modes rejection, $S_{21}$ ($TE_{10}$-TEM) and $S_{21}$ ($TE_{30}$-TEM) is better than 18.5 dB and 41 dB, respectively, in the frequency range from 8.3 GHz to 11.3 GHz with a fractional bandwidth of 30.6 percent (%). In particular, $S_{11}$ (TEM-TEM), $S_{21}$ ($TE_{20}$-TEM), $S_{21}$ ($TE_{10}$-TEM), and $S_{21}$ ($TE_{10}$-TEM) is better than 16.2 dB, 0.46 dB, 23.46 dB, and 52.92 dB, respectively, in the selected operation frequency band from 8.5 GHz to 11 GHz.

Figure 9:
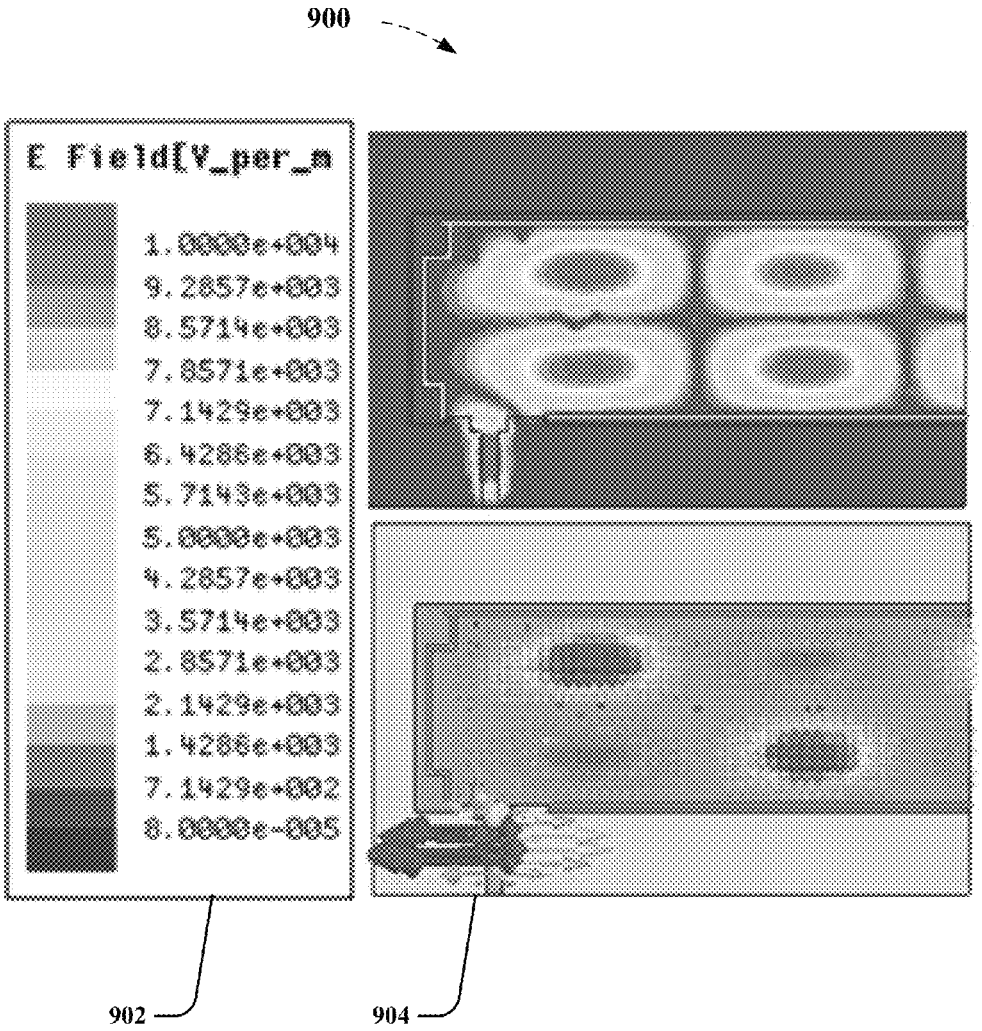
FIG. 9 depicts non-limiting electric field distributions for an exemplary EM mode transition or transducer structure of FIG. 7 at a frequency of 8.5 GigaHertz (GHz)
Figure 10:
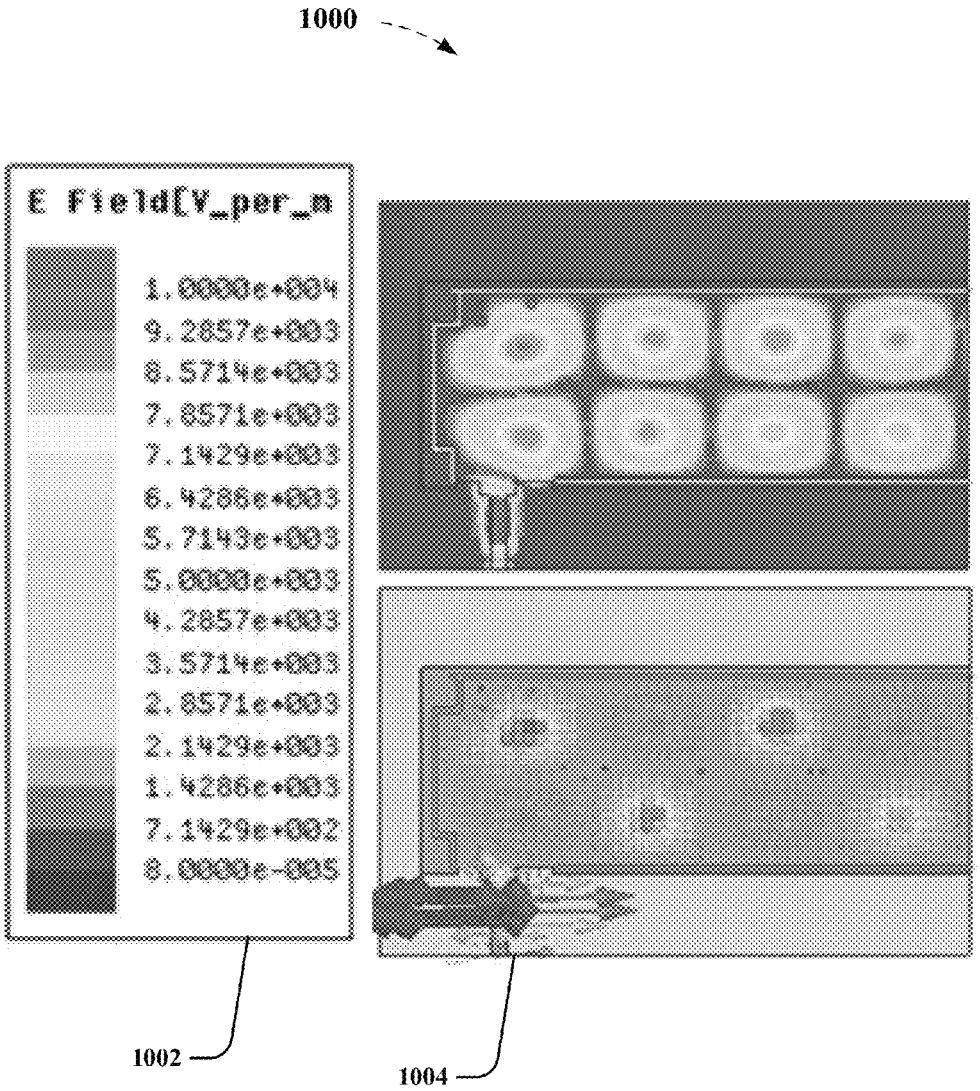
FIG. 10 depicts non-limiting electric field distributions for an exemplary EM mode transition or transducer structure of FIG. 7 at a frequency of 9.7 GHz.
Figure 11:
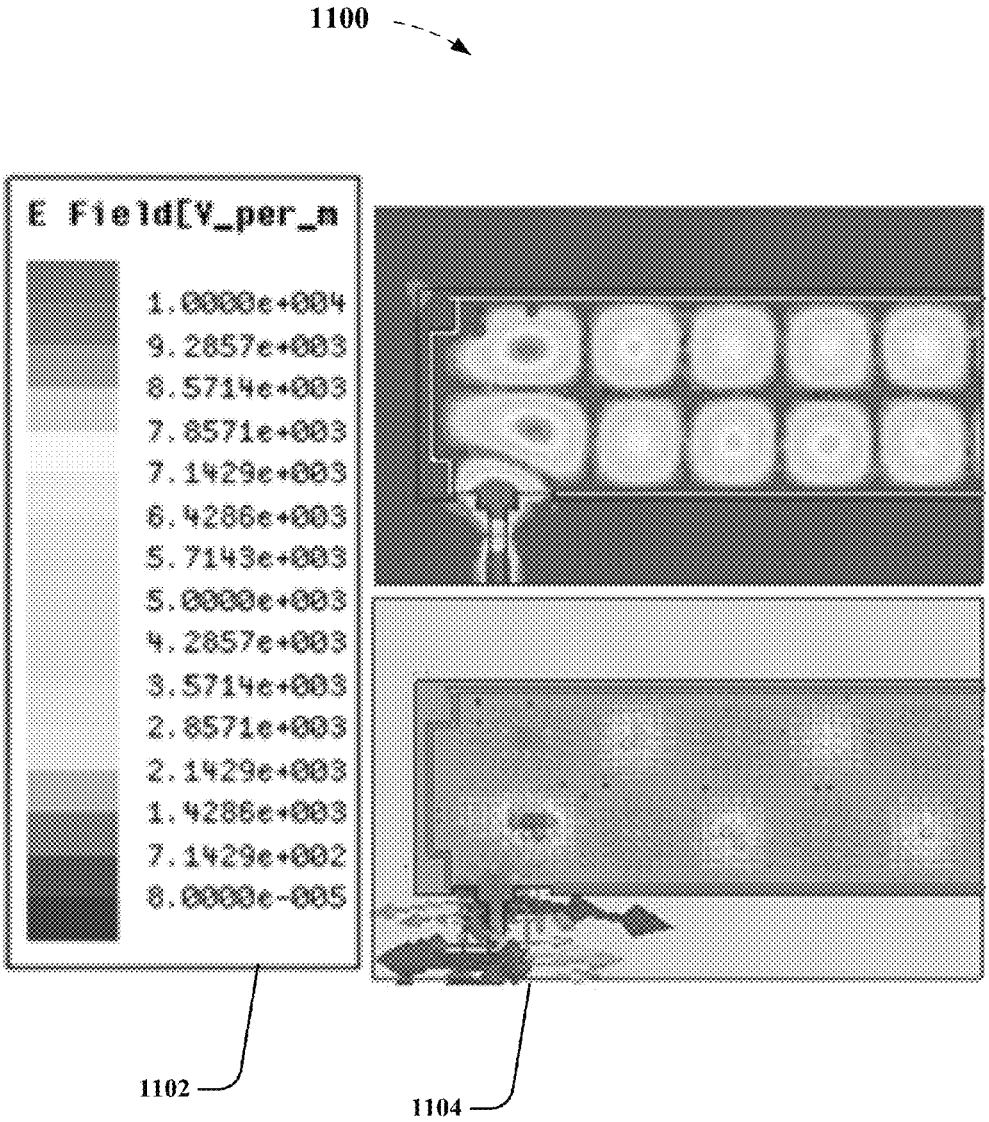
FIG. 11 depicts non-limiting electric field distributions for an exemplary EM mode transition or transducer structure of FIG. 7 at a frequency of 11 GHz.

FIG. 9 depicts non-limiting electric field distributions for an exemplary EM mode transition or transducer structure 700 of FIG. 7 at a frequency of 8.5 GHz, whereas FIG. 10 depicts non-limiting electric field distributions for an exemplary EM mode transition or transducer structure 700 of FIG. 7 at a frequency of 9.7 GHz, and FIG. 11 depicts non-limiting electric field distributions for an exemplary EM mode transition or transducer structure 700 of FIG. 7 at a frequency of 11 GHz. Thus, FIGS. 9-11 demonstrate performance of an exemplary EM mode transition or transducer structure 700, as described herein, by magnitude (902, 1002, 1102) and vector (904, 1004, 1104) distributions, which indicate that, for a broad bandwidth, only the $TE_{20}$ mode has been transmitted out of exemplary EM mode transition or transducer structure 700. As a result, an exemplary EM mode transition or transducer structure 700, as described herein, can be configured as a wideband EM mode transition between a fundamental mode transmission line and a $TE_{20}$ waveguide (not shown).

Figure 12:
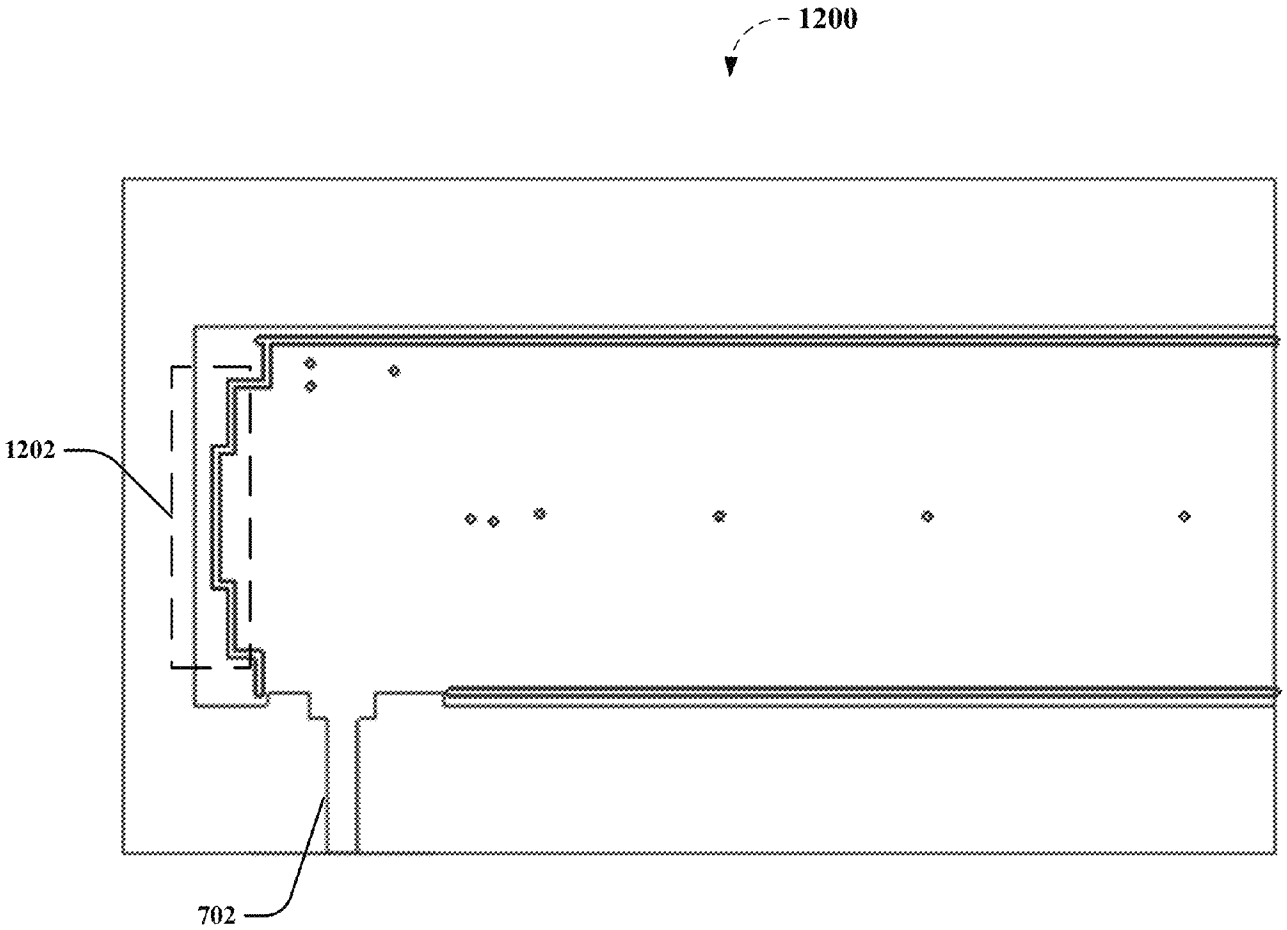
FIG. 12 depicts a top view of another exemplary EM mode transition or transducer structure, according to non-limiting aspects of the subject disclosure.

FIG. 12 depicts a top view of another exemplary EM mode transition or transducer structure 1200, according to non-limiting aspects of the subject disclosure. In particular non-limiting embodiments of the subject disclosure, an exemplary EM mode transition or transducer structure 1200 can be fabricated on a Rogers RT/Duroid® 5870 dielectric substrate that has a relative dielectric constant of 2.33, a thickness of 0.785 mm, and a dielectric loss tangent of 0.0012, for example, as described above regarding FIG. 7. However, as compared with exemplary EM mode transition or transducer structure 700 of FIG. 7, exemplary EM mode transition or transducer structure 1200 can further comprise one or more additional steps 1202 in step-shaped side wall 704 of the a waveguide cavity section 102 (e.g., an over-moded waveguide cavity section 102, etc.) to further improve bandwidth of exemplary EM mode transition or transducer structure 1200, according to a non-limiting aspect. In yet another non-limiting aspect, a waveguide cavity section 102 (e.g., an over-moded waveguide cavity section 102, etc.) of exemplary EM mode transition or transducer structure 1200 can further be configured in one or more of a rectangular shape, a trapezoidal shape, an arc shape, or a compound structural shape, and so on.

Figure 13:
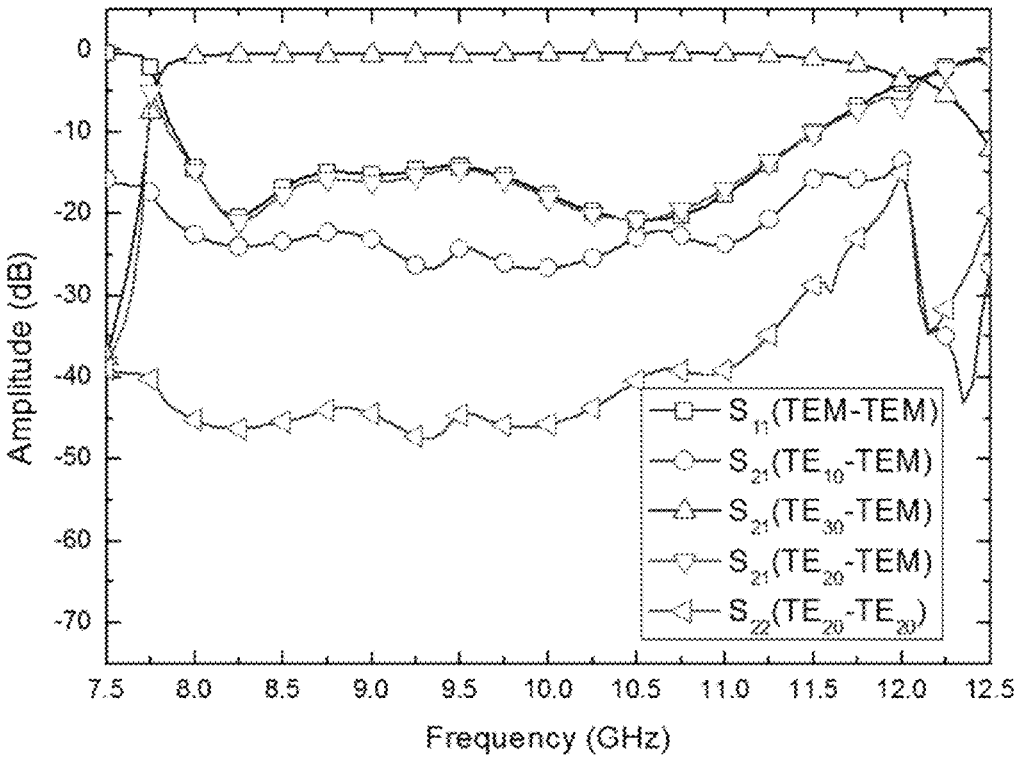
FIG. 13 demonstrates non-limiting aspects of transition performance for an exemplary EM mode transition or transducer structure of FIG. 12.

FIG. 13 demonstrates non-limiting aspects of transition performance 1300 for an exemplary EM mode transition or transducer structure 1200 of FIG. 12. For instance, in comparison of FIG. 13 (EM mode transition or transducer structure 1200) with FIG. 8 (EM mode transition or transducer structure 700), it can be seen that the bandwidth of exemplary EM mode transition or transducer structure 1200 can be improved by adding one or more additional steps 1202 in step-shaped side wall 704 of the a waveguide cavity section 102 (e.g., an over-moded waveguide cavity section 102, etc.). For example, $S_{11}$ (TEM-TEM), $S_{21}$ ($TE_{20}$-TEM), $S_{21}$ ($TE_{10}$-TEM), and $S_{21}$ ($TE_{30}$-TEM) is better than 14.3 dB, 0.8 dB, 21.7 dB, and 36 dB, respectively, in the selected operation frequency band from 8 GHz to 11.2 GHz, and with a fractional bandwidth of 33.3%.

Figure 14:
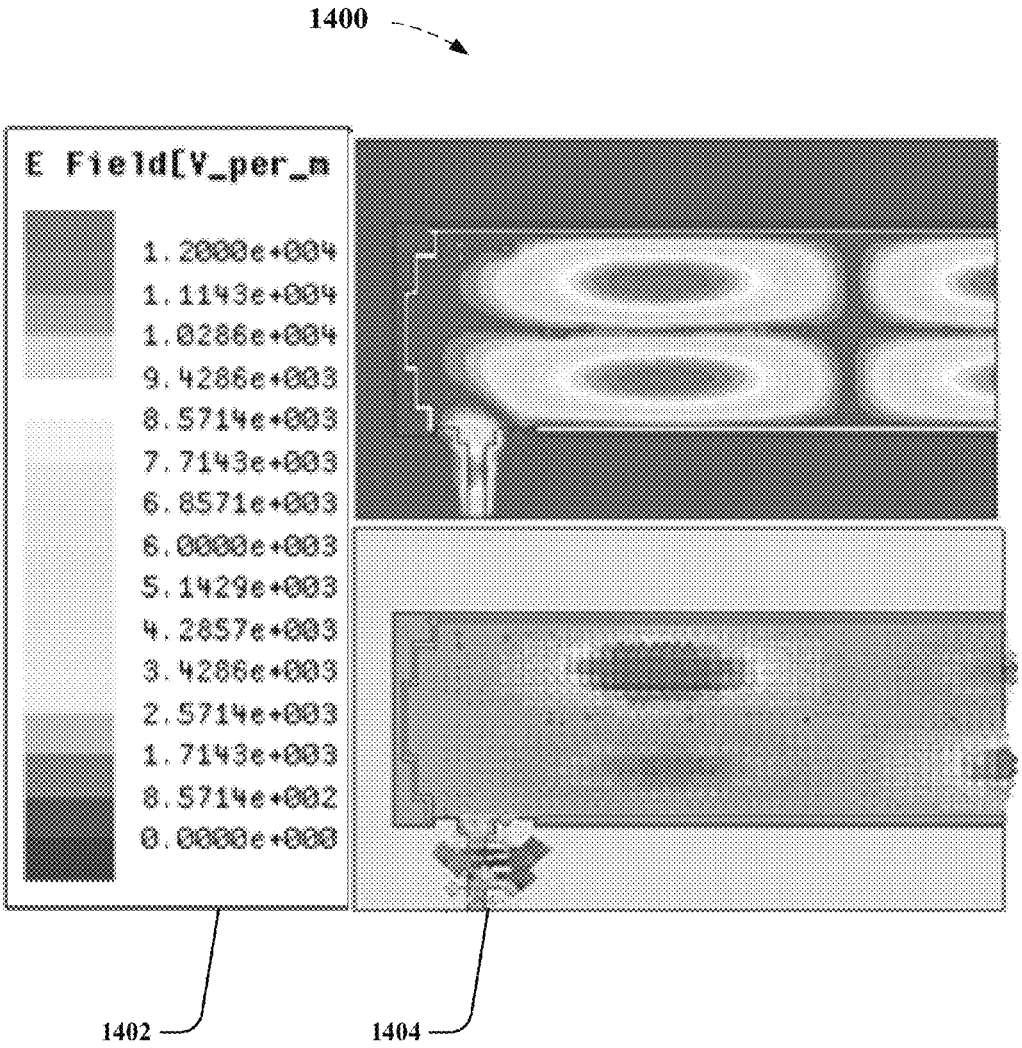
FIG. 14 depicts non-limiting electric field distributions for an exemplary EM mode transition or transducer structure of FIG. 12 at a frequency of 8.0 GHz.
Figure 15:
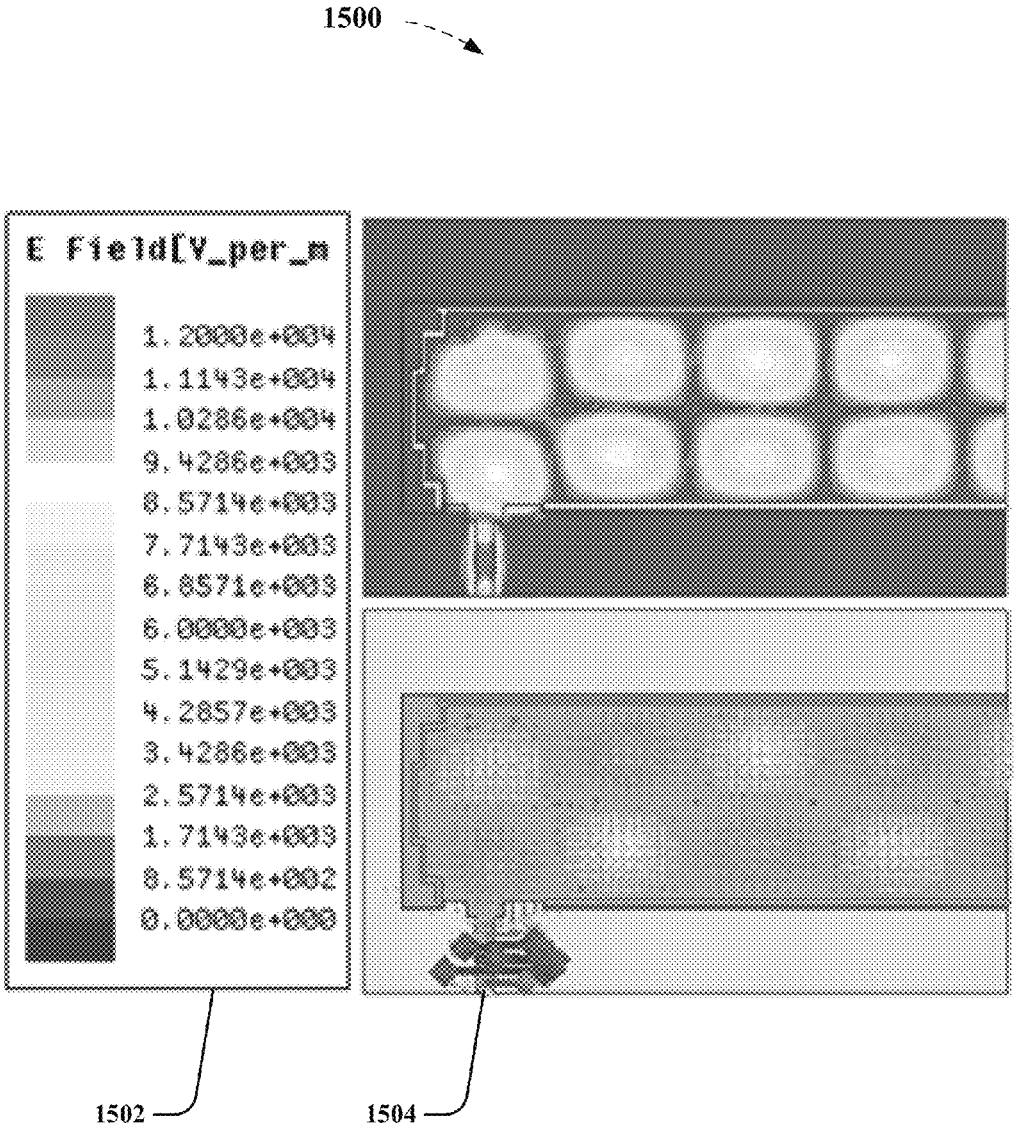
FIG. 15 depicts non-limiting electric field distributions for an exemplary EM mode transition or transducer structure of FIG. 12 at a frequency of 9.5 GHz.
Figure 16:
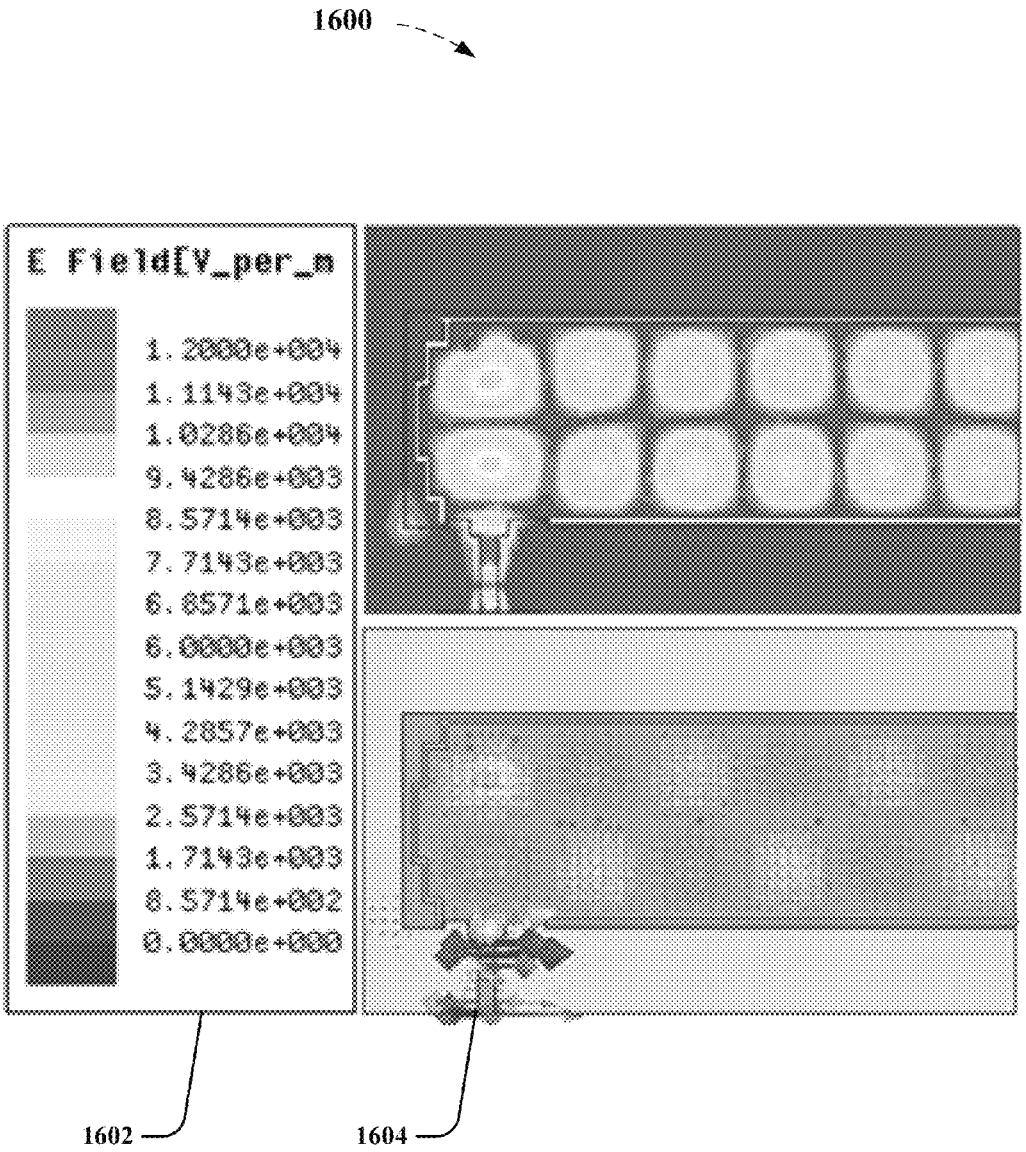
FIG. 16 depicts non-limiting electric field distributions for an exemplary EM mode transition or transducer structure of FIG. 12 at a frequency of 11 GHz.

FIG. 14 depicts non-limiting electric field distributions for an exemplary EM mode transition or transducer structure 1200 of FIG. 12 at a frequency of 8.0 GHz, whereas FIG. 15 depicts non-limiting electric field distributions for an exemplary EM mode transition or transducer structure 1200 of FIG. 12 at a frequency of 9.5 GHz, and FIG. 16 depicts non-limiting electric field distributions for an exemplary EM mode transition or transducer structure 1200 of FIG. 12 at a frequency of 11 GHz. Accordingly, FIGS. 14-16 demonstrate performance of an exemplary EM mode transition or transducer structure 1200, as described herein, by magnitude (1402, 1502, 1602) and vector (1404, 1504, 1604) distributions, which indicate that, for a broad bandwidth, only the $TE_{20}$ mode has been transmitted out of exemplary EM mode transition or transducer structure 1200. Thus, an exemplary EM mode transition or transducer structure 1200, as described herein, can be configured as a wideband EM mode transition between a fundamental mode transmission line and a $TE_{20}$ waveguide (not shown).

Figure 17:
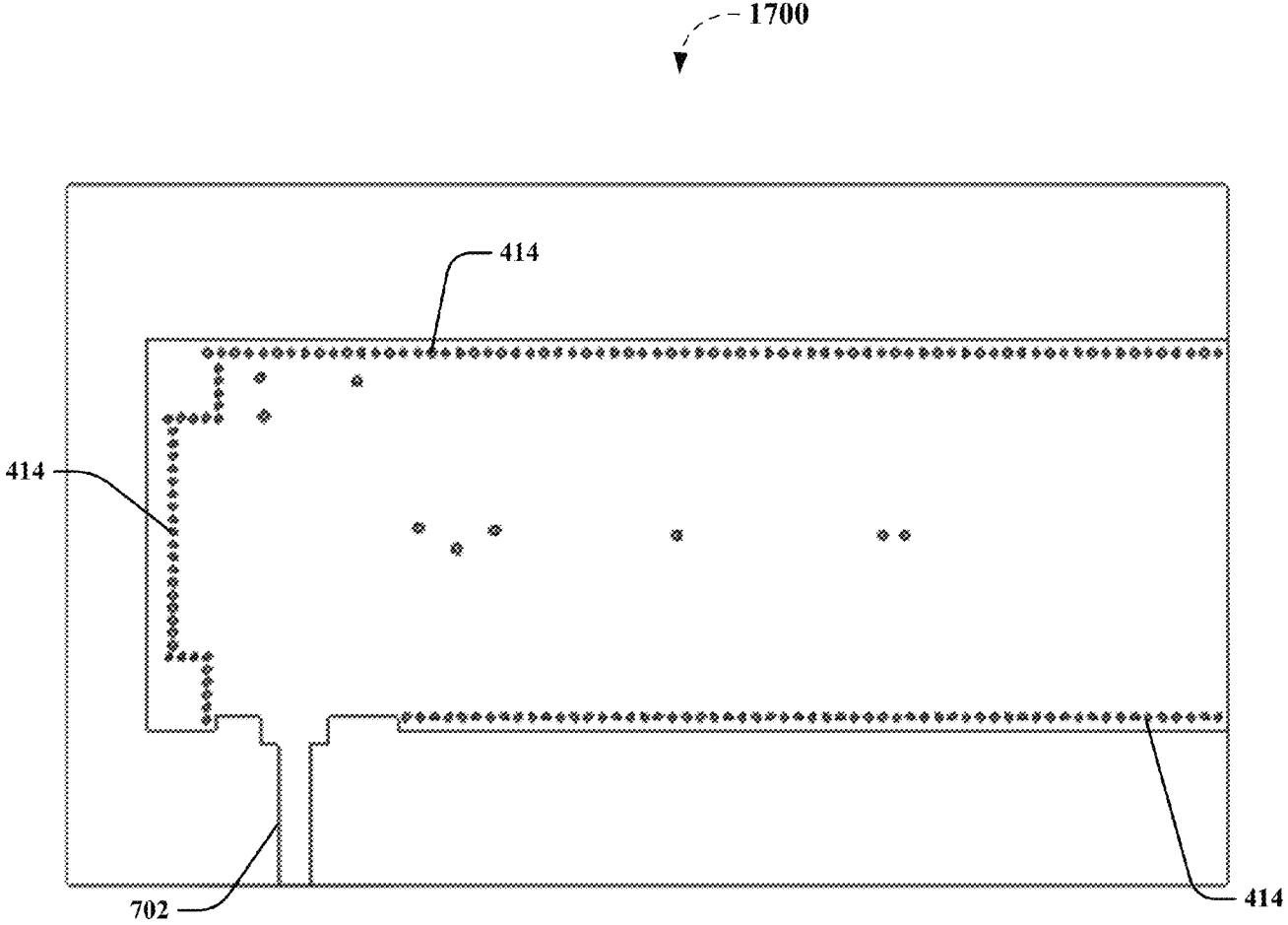
FIG. 17 depicts a top view of another exemplary EM mode transition or transducer structure, according to non-limiting aspects of the subject disclosure.
Figure 18:
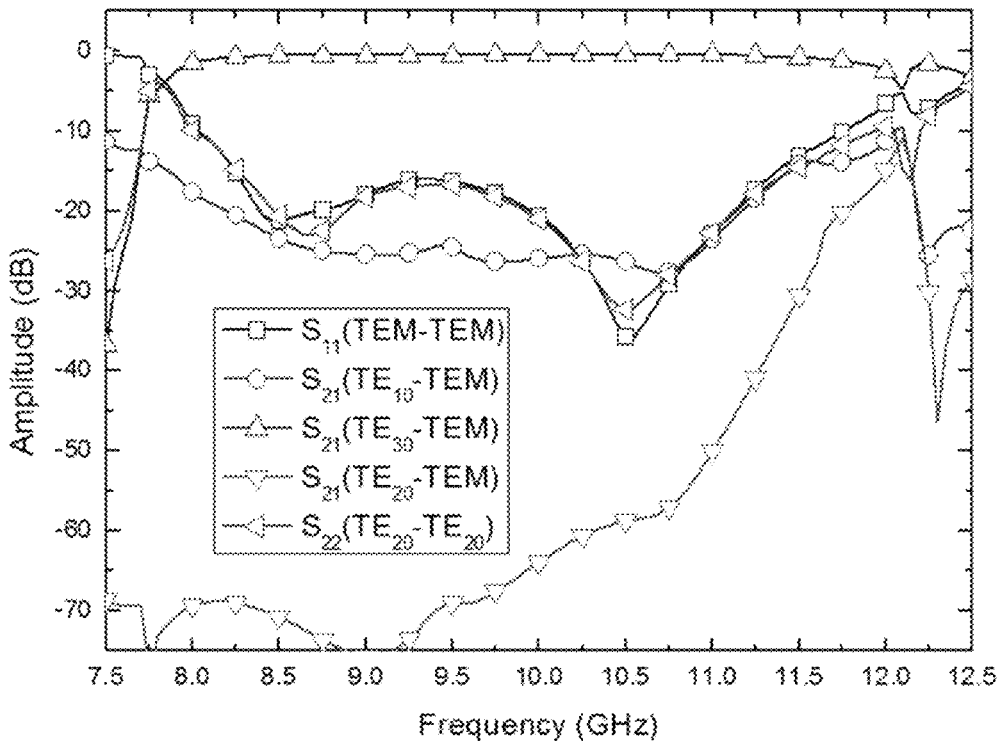
FIG. 18 demonstrates non-limiting aspects of transition performance for an exemplary EM mode transition or transducer structure of FIG. 17.

FIG. 17 depicts a top view of another exemplary EM mode transition or transducer structure 1700, according to non-limiting aspects of the subject disclosure, whereas FIG. 18 demonstrates non-limiting aspects of transition performance 1800 for an exemplary EM mode transition or transducer structure 1700 of FIG. 17. In particular non-limiting embodiments of the subject disclosure, an exemplary EM mode transition or transducer structure 1700 can be fabricated on a Rogers RT/Duroid® 5870 dielectric substrate that has a relative dielectric constant of 2.33, a thickness of 0.785 mm, and a dielectric loss tangent of 0.0012, for example, as described above regarding FIG. 7. However, as compared with exemplary EM mode transition or transducer structure 700 of FIG. 7, exemplary EM mode transition or transducer structure 1700 can alternatively comprise a set of metallic sidewall posts 414 that can support top substrate metal sheet 410 and bottom substrate metal sheet 412, as further described herein, for example, regarding FIG. 4. In yet another non-limiting aspect, a waveguide cavity section 402 (e.g., an over-moded waveguide cavity section 402, etc.) of exemplary EM mode transition or transducer structure 1200 can further be configured in one or more of a rectangular shape, a trapezoidal shape, an arc shape, or a compound structural shape, and so on. As with exemplary EM mode transition or transducer structure 700 and exemplary EM mode transition or transducer structure 1200, above, FIG. 18 depicts that good $TE_{20}$ mode transition can be achieved employing exemplary EM mode transition or transducer structure 1700, as described herein.

Figure 19:
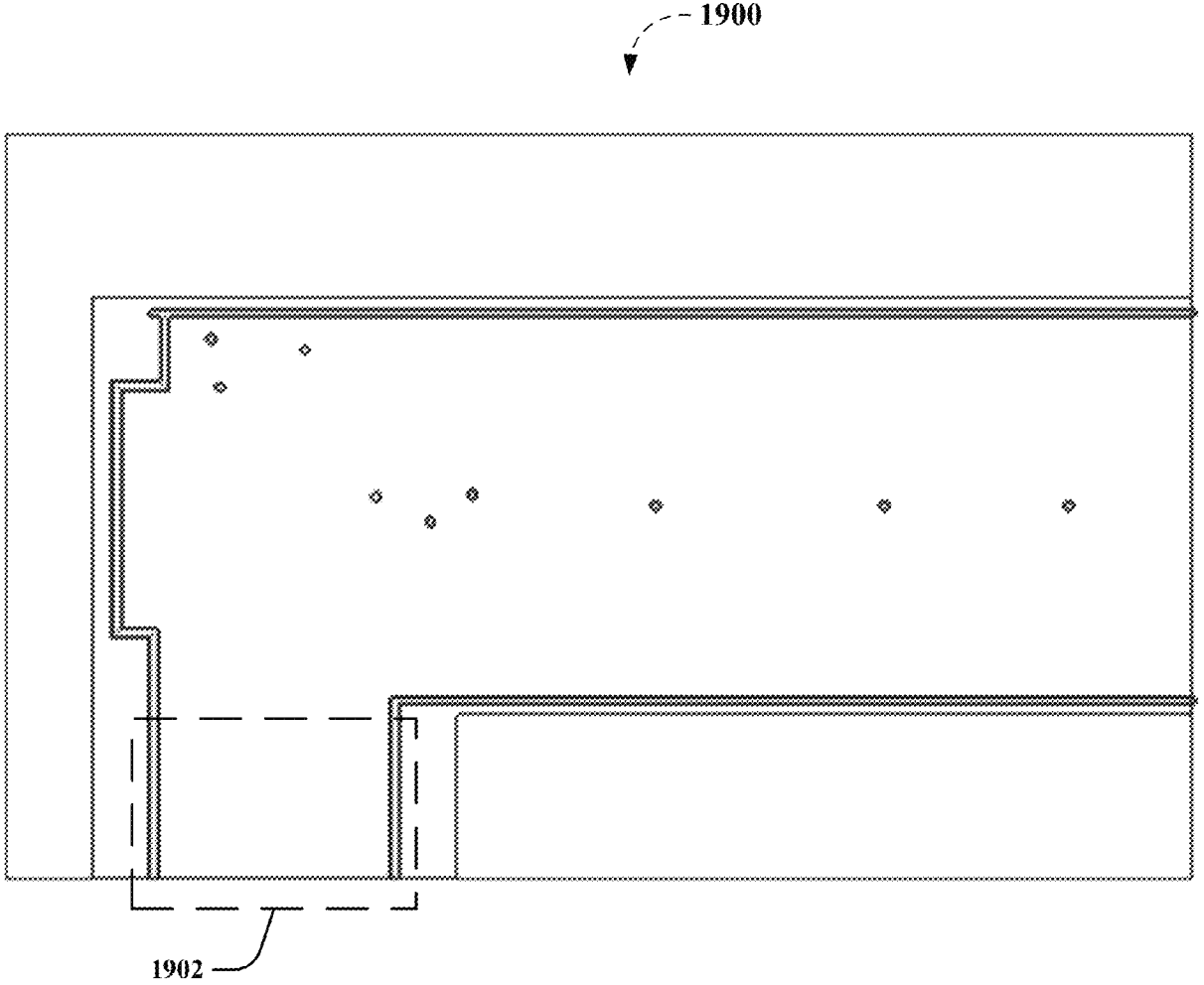
FIG. 19 depicts a top view of a further exemplary EM mode transition or transducer structure, according to further non-limiting aspects.
Figure 20:
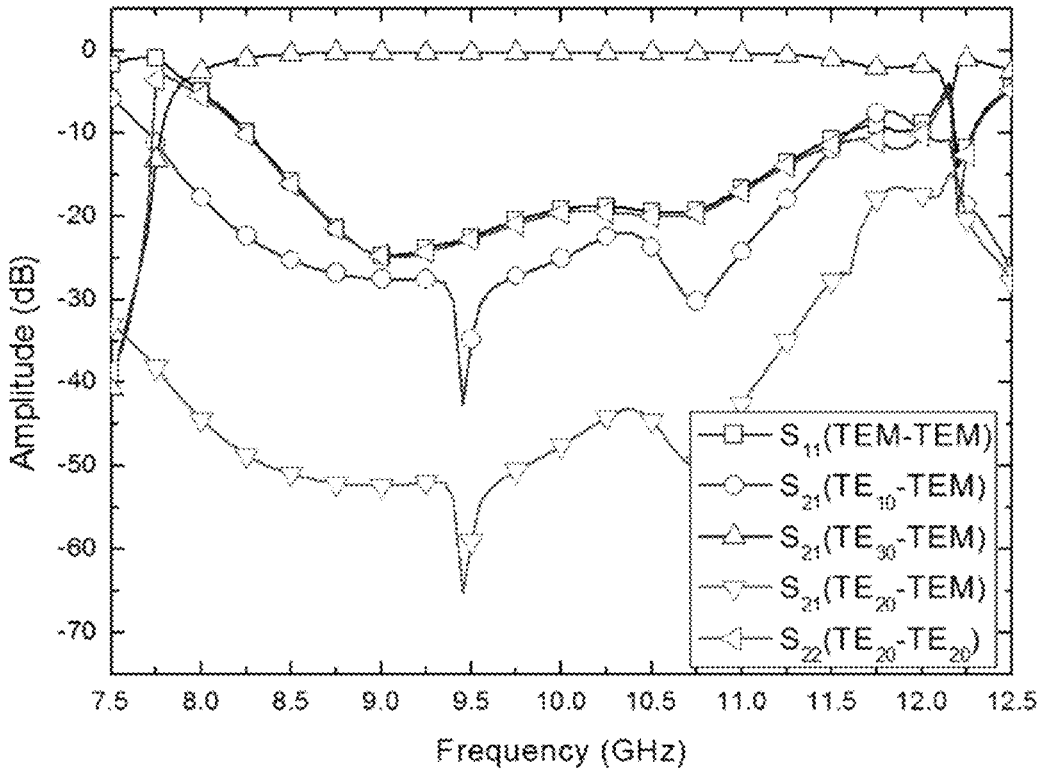
FIG. 20 demonstrates non-limiting aspects of transition performance for an exemplary EM mode transition or transducer structure of FIG. 19.

FIG. 19 depicts a top view of a further exemplary EM mode transition or transducer structure 1900, according to further non-limiting aspects, whereas FIG. 20 demonstrates non-limiting aspects of transition performance 2000 for an exemplary EM mode transition or transducer structure 1900 of FIG. 19. In particular non-limiting embodiments of the subject disclosure, an exemplary EM mode transition or transducer structure 1900 can be fabricated on a Rogers RT/Duroid® 5870 dielectric substrate that has a relative dielectric constant of 2.33, a thickness of 0.785 mm, and a dielectric loss tangent of 0.0012, for example, as described above regarding FIG. 7. However, as compared with exemplary EM mode transition or transducer structure 700 of FIG. 7, exemplary EM mode transition or transducer structure 1900 can comprise an exemplary EM mode transition or transducer structure 100 configured as an EM mode transition between a fundamental mode transmission line comprising a waveguide 1902, such as a laminated $TE_{10}$ mode waveguide 1902, and a $TE_{20}$ mode waveguide (not shown), such as a laminated $TE_{20}$ mode waveguide, for example, in a selected operation frequency band, such as, for example, the X band (e.g., EM waves having a frequency range of about 7 GHz to about 11.2 GHz, etc.), or a subset thereof. As with exemplary EM mode transition or transducer structures (700, 1200, 1700), above, FIG. 20 depicts that good $TE_{20}$ mode transition can be achieved employing exemplary EM mode transition or transducer structure 1900, as described herein.

Figure 21:
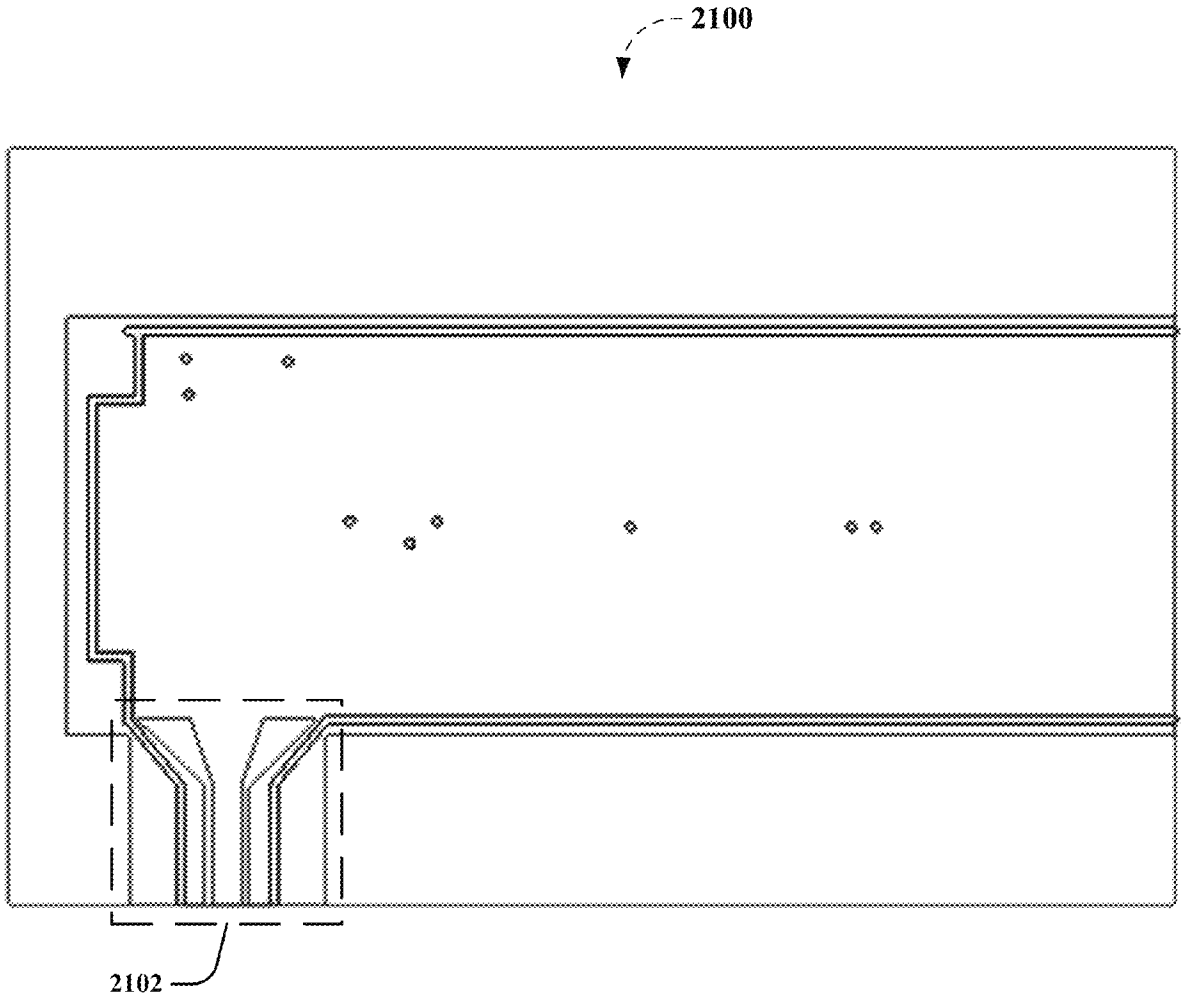
FIG. 21 depicts a top view of yet another exemplary EM mode transition or transducer structure, according to non-limiting aspects of the subject disclosure.
Figure 22:
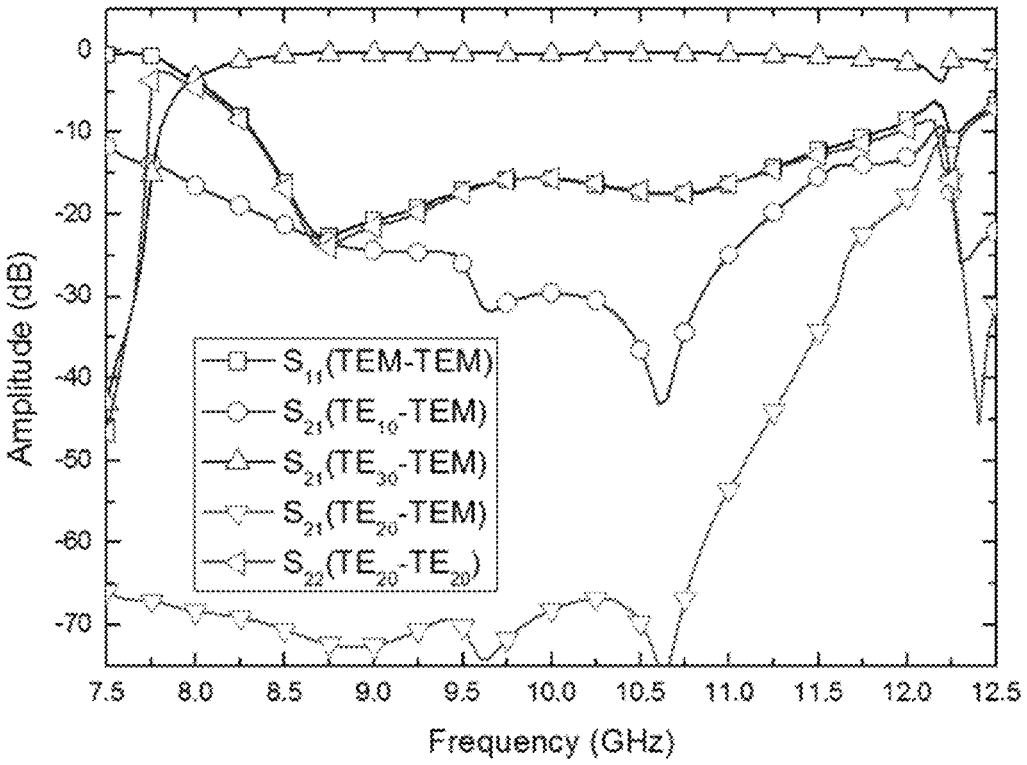
FIG. 22 demonstrates non-limiting aspects of transition performance for an exemplary EM mode transition or transducer structure of FIG. 21.

FIG. 21 depicts a top view of yet another exemplary EM mode transition or transducer structure 2100, according to non-limiting aspects of the subject disclosure, whereas FIG. 22 demonstrates non-limiting aspects of transition performance 2200 for an exemplary EM mode transition or transducer structure 2100 of FIG. 21. In particular non-limiting embodiments of the subject disclosure, an exemplary EM mode transition or transducer structure 2100 can be fabricated on a Rogers RT/Duroid® 5870 dielectric substrate that has a relative dielectric constant of 2.33, a thickness of 0.785 mm, and a dielectric loss tangent of 0.0012, for example, as described above regarding FIG. 7. However, as compared with exemplary EM mode transition or transducer structure 700 of FIG. 7, exemplary EM mode transition or transducer structure 2100 can comprise an exemplary EM mode transition or transducer structure 100 configured as an EM mode transition between a fundamental mode transmission line comprising a CPW, such as a CPW 2102, and a $TE_{20}$ mode waveguide (not shown), such as a laminated $TE_{20}$ mode waveguide, for example, in a selected operation frequency band, such as, for example, the X band (e.g., EM waves having a frequency range of about 7 GHz to about 11.2 GHz, etc.), or a subset thereof. Accordingly, in a non-limiting aspect EM mode transition or transducer structure 2100 can be fed and excited by a CPW 2102, directly. As with exemplary EM mode transition or transducer structures (700, 1200, 1700, 1900), above, FIG. 22 depicts that good $TE_{20}$ mode transition can be achieved employing exemplary EM mode transition or transducer structure 2100, as described herein.

Accordingly, in non-limiting embodiments, the subject disclosure provides exemplary devices comprising an EM mode transition or transducer (e.g., EM mode transition or transducer structure 100, 400, 700, 1200, 1700, 1900, 2100, etc.). In a non-limiting aspect, exemplary devices can comprise a waveguide cavity section (e.g., such as waveguide cavity section 102 comprising an over-moded waveguide cavity section 102, waveguide cavity section 402 comprising an over-moded waveguide cavity section 402, etc.). In various non-limiting aspects as described herein, the waveguide cavity section (e.g., over-moded waveguide cavity section 102, over-moded waveguide cavity section 402, etc.) can be configured in one or more of a rectangular shape, a trapezoidal shape, an arc shape, a compound structural shape, and so on, including other suitable shapes. In further non-limiting aspects, the fundamental mode rejection section (e.g., fundamental mode rejection section 104, fundamental mode rejection section 404, etc.) can be configured for $TE_{20}$ mode transmission and $TE_{30}$ mode suppression. In addition, the waveguide cavity section (e.g., over-moded waveguide cavity section 102, over-moded waveguide cavity section 402, etc.) can comprise one or more stepped transitions in a side wall (e.g., step-shaped side wall 704, one or more additional steps 1202 in step-shaped side wall 704, and/or comprising metallic sidewalls 114, comprising metallic sidewall posts 414, etc.) of the waveguide cavity section. As further described herein, the waveguide cavity section (e.g., over-moded waveguide cavity section 102, over-moded waveguide cavity section 402, etc.) can comprise a set of impedance matching metallic posts (e.g., a set of impedance matching metallic posts 122, a set of impedance matching metallic posts 422, etc.).

According to still other non-limiting embodiments, exemplary devices can also comprise a fundamental mode rejection section (e.g., fundamental mode rejection section 104, fundamental mode rejection section 404, etc.). In a non-limiting aspect, the fundamental mode rejection section (e.g., fundamental mode rejection section 104, fundamental mode rejection section 404, etc.) can be located proximate to the waveguide cavity section (e.g., over-moded waveguide cavity section 102, over-moded waveguide cavity section 402, etc.) opposite a first port (e.g., first port 106, first port 406) that can be configured to connect a fundamental mode transmission line, such as a microstrip transmission line (e.g., microstrip transmission line 702, etc.), a strip line, a waveguide (e.g., waveguide 1902, etc.), or a coplanar waveguide (e.g., CPW 2102, etc.), to the waveguide cavity section (e.g., such as waveguide cavity section 102 comprising an over-moded waveguide cavity section 102, waveguide cavity section 402 comprising an over-moded waveguide cavity section 402, etc.) of the EM mode transducer.

Accordingly, exemplary devices comprising an EM mode transition or transducer, according to further non-limiting aspects, can be configured as transition between a fundamental mode transmission line, such as a microstrip transmission line (e.g., microstrip transmission line 702, etc.), a strip line, a waveguide (e.g., waveguide 1902, etc.), or a coplanar waveguide (e.g., CPW 2102, etc.), and a $TE_{20}$ mode waveguide, for example, as further described herein. Exemplary devices comprising an EM mode transition or transducer (e.g., EM mode transition or transducer structure 100, 400, 700, 1200, 1700, 1900, 2100, etc.) can be further configured as an EM mode transducer in at least one of a SIW, a laminated waveguide, or a metal waveguide.

In a non-limiting aspect, exemplary devices comprising an EM mode transition or transducer (e.g., EM mode transition or transducer structure 100, 400, 700, 1200, 1700, 1900, 2100, etc.) can comprise top and bottom substrate metal sheets (e.g., a top substrate metal sheet 110 and a bottom substrate metal sheet 112, etc.) supported by one of a set of narrow metallic sidewalls (e.g., a set of narrow metallic sidewalls 114), a set of metallic sidewall posts (e.g., a set of metallic sidewall posts 414), etc.

In further non-limiting embodiments, exemplary devices comprising an EM mode transition or transducer (e.g., EM mode transition or transducer structure 100, 400, 700, 1200, 1700, 1900, 2100, etc.) can further comprise a first port (e.g., first port 106, first port 406) that can be configured to connect the fundamental mode transmission line to the waveguide cavity section (e.g., such as waveguide cavity section 102 comprising an over-moded waveguide cavity section 102, waveguide cavity section 402 comprising an over-moded waveguide cavity section 402, etc.) of the EM mode transducer. In a further non-limiting aspect, the waveguide cavity section can also comprise an over-moded waveguide cavity section (e.g., over-moded waveguide cavity section 102, over-moded waveguide cavity section 402, etc.) configured to propagate or excite more than one mode of EM waves in a selected operation frequency band, such as, for example, the X band (e.g., EM waves having a frequency range of about 7 GHz to about 11.2 GHz, etc.), or a subset thereof. In yet another non-limiting aspect, a selected operation frequency band can comprise frequencies in a frequency range of about 8 GHz to about 11.2 GHz.

In still other non-limiting embodiments, exemplary devices comprising an EM mode transition or transducer (e.g., EM mode transition or transducer structure 100, 400, 700, 1200, 1700, 1900, 2100, etc.) can further comprise an array of metallic posts (e.g., an array of metallic posts 118, an array of metallic posts 418, etc.) located proximate to a centerline 120, 420 of the fundamental mode rejection section (e.g., fundamental mode rejection section 104, fundamental mode rejection section 404, etc.). In a non-limiting aspect, the array of metallic posts can be oriented in a longitudinal direction of the EM mode transducer. In yet another non-limiting aspect, exemplary devices comprising an EM mode transition or transducer a set of vias located along the fundamental mode rejection section (e.g. a set of vias (e.g., set of vias 712, 714, 716, 718, 720, and 722, etc.) in a substrate associated with exemplary devices comprising an EM mode transition or transducer).

In further non-limiting embodiments, exemplary devices comprising an EM mode transition or transducer (e.g., EM mode transition or transducer structure 100, 400, 700, 1200, 1700, 1900, 2100, etc.) can further comprise a second port (e.g., second port 108, second port 408) located proximate to the fundamental mode rejection section (e.g., fundamental mode rejection section 104, fundamental mode rejection section 404, etc.) and opposite the waveguide cavity section (e.g., over-moded waveguide cavity section 102, over-moded waveguide cavity section 402, etc.). Moreover, in a further non-limiting aspect, the second port can be configured to propagate a $TE_{20}$ mode of EM waves (e.g., EM waves carried in exemplary devices comprising an EM mode transition or transducer) to a $TE_{20}$ mode waveguide.

Accordingly, in still other non-limiting embodiments, the subject disclosure provides exemplary apparatuses that can be configured as an EM mode transition or transducer (e.g., EM mode transition or transducer structure 100, 400, 700, 1200, 1700, 1900, 2100, etc.). For instance, exemplary apparatuses as described herein can comprise means for transmitting or receiving EM waves to or from a fundamental mode transmission line, for example, as further described herein, regarding FIGS. 1, 4, 7, 12, 17, 19, 21, 23. As a further example, an exemplary means for transmitting or receiving EM waves can comprise, but are not limited to, a first port (e.g., first port 106, first port 406) of an exemplary EM mode transition or transducer structure 100, 400, 700, 1200, 1700, 1900, 2100, etc. In yet another example, an exemplary means for transmitting or receiving EM waves can comprise, but are not limited to, an attached or associated fundamental mode transmission line, such as a microstrip transmission line (e.g., microstrip transmission line 702, etc.), a strip line, a waveguide (e.g., waveguide 1902, etc.), a coplanar waveguide (e.g., CPW 2102, etc.), or combinations, variations, and/or portions thereof, for example, as further described herein.

In still other exemplary implementations, exemplary apparatuses as described herein can comprise means for suppressing a $TE_{30}$ mode of the EM waves. For instance, exemplary means for suppressing a $TE_{30}$ mode can comprise, but are not limited to, a fundamental mode rejection section (e.g., fundamental mode rejection section 104, fundamental mode rejection section 404, etc.). In further non-limiting examples, exemplary means for suppressing can have a width (e.g., a width W1 116, a width W1 416, etc.) selected to suppress the $TE_{30}$ mode of the EM waves. Exemplary means for suppressing a $TE_{30}$ mode can further comprise, but are not limited to, an array of metallic posts (e.g., an array of metallic posts 118, an array of metallic posts 418, etc.) located proximate to a centerline 120, 420 of the fundamental mode rejection section (e.g., fundamental mode rejection section 104, fundamental mode rejection section 404, etc.). For instance, as described herein, a waveguide comprising a cavity section can comprise an over-moded waveguide cavity section (e.g., over-moded waveguide cavity section 102, over-moded waveguide cavity section 402, etc.) configured to propagate or excite more than one mode of EM waves in a selected operation frequency band, such as, for example, the X band (e.g., EM waves having a frequency range of about 7 GHz to about 11.2 GHz, etc.), or a subset thereof. In yet another non-limiting aspect, a selected operation frequency band can comprise frequencies in a frequency range of about 8 GHz to about 11.2 GHz.

In further non-limiting embodiments, exemplary apparatuses as described herein can also comprise means for impedance matching associated with the means for suppressing. In a non-limiting aspect, exemplary means for impedance matching can comprise, but are not limited to, a set of impedance matching metallic posts (e.g., a set of impedance matching metallic posts 122, a set of impedance matching metallic posts 422, etc.) located in a waveguide comprising a cavity section (e.g., over-moded waveguide cavity section 102, over-moded waveguide cavity section 402, etc.). In further non-limiting aspects, as described herein, exemplary apparatuses can comprise means for adjusting bandwidth associated with the means for suppressing. As a non-limiting example, exemplary means for adjusting bandwidth can comprise, but are not limited to, a set of impedance matching metallic posts (e.g., a set of impedance matching metallic posts 122, a set of impedance matching metallic posts 422, etc.) located in a waveguide comprising a cavity section (e.g., over-moded waveguide cavity section 102, over-moded waveguide cavity section 402, etc.). In still further non-limiting aspects, as described herein, exemplary means for adjusting bandwidth can comprise, but are not limited to, one or more stepped transitions in a side wall (e.g., step-shaped side wall 704, one or more additional steps 1202 in step-shaped side wall 704, comprising metallic sidewalls 114, comprising metallic sidewall posts 414, etc.) of the waveguide cavity section.

In addition, exemplary apparatuses as described herein can comprise means for reflecting or suppressing a $TE_{10}$ mode of the EM waves. As a non-limiting example, exemplary means for reflecting or suppressing a $TE_{10}$ mode of the EM waves can comprise, but are not limited to, a fundamental mode rejection section (e.g., fundamental mode rejection section 104, fundamental mode rejection section 404, etc.). In a further example, exemplary means for reflecting or suppressing a $TE_{10}$ mode of the EM waves can comprise, but are not limited to, metallic posts located along a propagation path for the EM waves. For instance, as further described herein, exemplary means for reflecting or suppressing a $TE_{10}$ mode of the EM waves can comprise, but are not limited to, an array of metallic posts (e.g., an array of metallic posts 118, an array of metallic posts 418, etc.) located proximate to a centerline 120, 420 of the fundamental mode rejection section (e.g., fundamental mode rejection section 104, fundamental mode rejection section 404, etc.).

In other non-limiting embodiments, exemplary apparatuses as described herein can comprise means for controlling propagation of a $TE_{20}$ mode of the EM waves from the fundamental mode transmission line. For instance, exemplary means for controlling propagation of a $TE_{20}$ mode of the EM waves can comprise, but are not limited to, a waveguide comprising a cavity section can comprise an over-moded waveguide cavity section (e.g., over-moded waveguide cavity section 102, over-moded waveguide cavity section 402, etc.) configured to propagate or excite more than one mode of EM waves in a selected operation frequency band, such as, for example, the X band (e.g., EM waves having a frequency range of about 7 GHz to about 11.2 GHz, etc.), or a subset thereof. In addition, exemplary means for controlling propagation of a $TE_{20}$ mode of the EM waves can comprise, but are not limited to, a fundamental mode rejection section (e.g., fundamental mode rejection section 104, fundamental mode rejection section 404, etc.) of the exemplary apparatuses.

Figure 23:
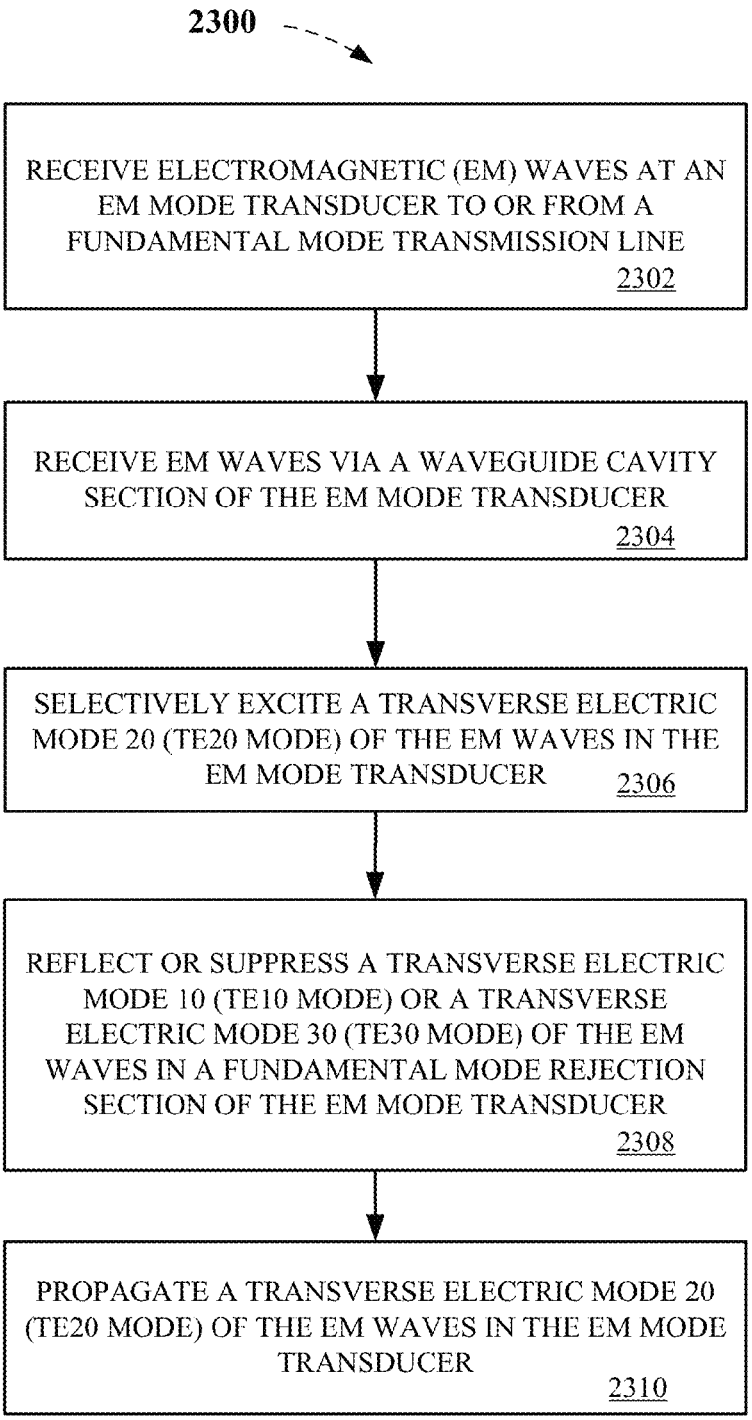
FIG. 23 depicts an exemplary flowchart of non-limiting methods associated with various non-limiting embodiments of the subject disclosure.

In view of the subject matter described supra, methods that can be implemented in accordance with the subject disclosure will be better appreciated with reference to the flowcharts of FIG. 23. While for purposes of simplicity of explanation, the methods are shown and described as a series of blocks, it is to be understood and appreciated that such illustrations or corresponding descriptions are not limited by the order of the blocks, as some blocks may occur in different orders and/or concurrently with other blocks from what is depicted and described herein. Any non-sequential, or branched, flow illustrated via a flowchart should be understood to indicate that various other branches, flow paths, and orders of the blocks, can be implemented which achieve the same or a similar result. Moreover, not all illustrated blocks may be required to implement the methods described hereinafter.

Exemplary Methods

While various embodiments of the subject disclosure may be described in the context of a particular direction of wave propagation, it is to be appreciated that, as passive devices, the opposite direction of wave propagation is also possible without deviating from the scope of the described embodiments. As a non-limiting example, where EM waves are described as propagating from a fundamental mode transmission line to a $TE_{20}$ mode waveguide, exemplary methods 2300 of FIG. 23, it is to be appreciated that EM waves can also be propagated from a $TE_{20}$ mode waveguide, for example, to a fundamental mode transmission line such as described regarding exemplary methods 2400 of FIG. 24. Accordingly, exemplary methods can comprise transmitting or receiving EM waves at an EM mode transition or transducer (e.g., EM mode transition or transducer structure 100, 400, 700, 1200, 1700, 1900, 2100, etc.) to or from a fundamental mode transmission line, such as a microstrip transmission line (e.g., microstrip transmission line 702, etc.), a strip line, a waveguide (e.g., waveguide 1902, etc.), a coplanar waveguide (e.g., CPW 2102, etc.), or combinations, variations, and/or portions thereof.

As a non-limiting example, exemplary methods can comprise transmitting or receiving the EM waves via an over-moded waveguide cavity section of the EM mode transducer, such as an over-moded waveguide cavity section (e.g., over-moded waveguide cavity section 102, over-moded waveguide cavity section 402, etc.) configured to propagate or excite more than one mode of EM waves in a selected operation frequency band, such as, for example, the X band (e.g., EM waves having a frequency range of about 7 GHz to about 11.2 GHz, etc.), or a subset thereof. In yet another non-limiting aspect, a selected operation frequency band can comprise frequencies in a frequency range of about 8 GHz to about 11.2 GHz. Accordingly, exemplary methods can comprise transmitting or receiving the EM waves via an over-moded waveguide cavity section of the EM mode transducer configured to propagate or excite more than one mode of the EM waves over a selected frequency range (e.g., a selected frequency range of about 8 GHz to about 11.2 GHz, etc.). In a non-limiting aspect, exemplary methods can further comprise influencing bandwidth using stepped sidewalls, such as by, for example, employing one or more stepped transitions in a side wall (e.g., step-shaped side wall 704, one or more additional steps 1202 in step-shaped side wall 704, and comprising metallic sidewalls 114, comprising metallic sidewall posts 414, etc.) of the waveguide cavity section. In a further non-limiting aspect, exemplary methods can further comprise impedance matching using metallic posts in the over-moded waveguide cavity section of the EM mode transducer, such as by, for example, employing a set of impedance matching metallic posts (e.g., a set of impedance matching metallic posts 122, a set of impedance matching metallic posts 422, etc.) located in the over-moded waveguide cavity section (e.g., over-moded waveguide cavity section 102, over-moded waveguide cavity section 402, etc.).

In addition, exemplary methods can further comprise selectively propagating or exciting, in the fundamental mode rejection section (e.g., fundamental mode rejection section 104, fundamental mode rejection section 404, etc.), such as, for example, a fundamental mode rejection section that has a width W1 116 selected to suppress the $TE_{30}$ mode of the EM waves in the EM mode transducer. Thus, exemplary methods can further comprise selectively propagating or exciting the $TE_{20}$ mode of the EM waves, in the fundamental mode rejection section (e.g., fundamental mode rejection section 104, fundamental mode rejection section 404, etc.), such as, for example, a fundamental mode rejection section that has a width W1 116 selected to selectively propagate or excite the $TE_{20}$ mode of the EM waves in the EM mode transducer.

Exemplary methods can further comprise one or more of reflecting or suppressing one or more of a $TE_{10}$ mode or a $TE_{30}$ mode of the EM waves in a fundamental mode rejection section (e.g., fundamental mode rejection section 104, fundamental mode rejection section 404, etc.) of the EM mode transducer. In a further example, reflecting or suppressing a $TE_{10}$ mode or a $TE_{30}$ mode of the EM waves can be facilitated by employing metallic posts located along a propagation path for the EM waves, as further described herein, such as by, for example, employing an array of metallic posts (e.g., an array of metallic posts 118, an array of metallic posts 418, etc.) located proximate to a centerline 120, 420 of the fundamental mode rejection section (e.g., fundamental mode rejection section 104, fundamental mode rejection section 404, etc.). As a further non-limiting example, exemplary methods can further comprise selectively suppressing, in the fundamental mode rejection section (e.g., fundamental mode rejection section 104, fundamental mode rejection section 404, etc.), such as, for example, a fundamental mode rejection section that has a width W1 116 selected to suppress the $TE_{30}$ mode of the EM waves in the EM mode transducer. In addition, selectively suppressing a $TE_{30}$ mode can further comprise, but are not limited to, selectively suppressing the $TE_{30}$ mode using an array of metallic posts (e.g., an array of metallic posts 118, an array of metallic posts 418, etc.) located proximate to a centerline 120, 420 of the fundamental mode rejection section (e.g., fundamental mode rejection section 104, fundamental mode rejection section 404, etc.). Moreover, exemplary methods can comprise propagating a $TE_{20}$ mode of the EM waves in the EM mode transducer (e.g., EM mode transition or transducer structure 100, 400, 700, 1200, 1700, 1900, 2100, etc.).

Accordingly, FIG. 23 depicts an exemplary flowchart of non-limiting methods 2300 associated with various non-limiting embodiments of the subject disclosure. As a non-limiting example, exemplary methods 2300 can comprise receiving EM waves at an EM mode transition or transducer (e.g., EM mode transition or transducer structure 100, 400, 700, 1200, 1700, 1900, 2100, etc.) from a fundamental mode transmission line, such as a microstrip transmission line (e.g., microstrip transmission line 702, etc.), a strip line, a waveguide (e.g., waveguide 1902, etc.), a coplanar waveguide (e.g., CPW 2102, etc.), or combinations, variations, and/or portions thereof, at 2302.

As a further non-limiting example, at 2304, exemplary methods 2300 can comprise receiving the EM waves via an over-moded waveguide cavity section of the EM mode transducer, such as an over-moded waveguide cavity section (e.g., over-moded waveguide cavity section 102, over-moded waveguide cavity section 402, etc.) configured to propagate or excite more than one mode of EM waves in a selected operation frequency band, such as, for example, the X band (e.g., EM waves having a frequency range of about 7 GHz to about 11.2 GHz, etc.), or a subset thereof. In yet another non-limiting aspect, a selected operation frequency band can comprise frequencies in a frequency range of about 8 GHz to about 11.2 GHz. Accordingly, at 2304, exemplary methods 2300 can comprise transmitting or receiving the EM waves via an over-moded waveguide cavity section of the EM mode transducer configured to propagate or excite more than one mode of the EM waves over a selected frequency range (e.g., a selected frequency range of about 8 GHz to about 11.2 GHz, etc.). In a non-limiting aspect of exemplary methods 2300, at 2304, exemplary methods 2300 can further comprise influencing bandwidth using stepped sidewalls, such as by, for example, employing one or more stepped transitions in a side wall (e.g., step-shaped side wall 704, one or more additional steps 1202 in step-shaped side wall 704, and comprising metallic sidewalls 114, comprising metallic sidewall posts 414, etc.) of the waveguide cavity section. In a further non-limiting aspect of exemplary methods 2300, at 2304, exemplary methods 2300 can further comprise impedance matching using metallic posts in the over-moded waveguide cavity section of the EM mode transducer, such as by, for example, employing a set of impedance matching metallic posts (e.g., a set of impedance matching metallic posts 122, a set of impedance matching metallic posts 422, etc.) located in the over-moded waveguide cavity section (e.g., over-moded waveguide cavity section 102, over-moded waveguide cavity section 402, etc.).

In addition, exemplary methods 2300 can further comprise selectively propagating or exciting, in the fundamental mode rejection section (e.g., fundamental mode rejection section 104, fundamental mode rejection section 404, etc.), such as, for example, a fundamental mode rejection section that has a width W1 116 selected to suppress the $TE_{20}$ mode of the EM waves in the EM mode transducer, at 2306. Thus, exemplary methods 2300 can further comprise selectively propagating or exciting the $TE_{20}$ mode of the EM waves, in the fundamental mode rejection section (e.g., fundamental mode rejection section 104, fundamental mode rejection section 404, etc.), such as, for example, a fundamental mode rejection section that has a width W1 116 selected to selectively propagate or excite the $TE_{20}$ mode of the EM waves in the EM mode transducer, at 2306.

Exemplary methods 2300 can further comprise one or more of reflecting or suppressing one or more of a $TE_{10}$ mode or a $TE_{30}$ mode of the EM waves in a fundamental mode rejection section (e.g., fundamental mode rejection section 104, fundamental mode rejection section 404, etc.) of the EM mode transducer, at 2308. In a non-limiting example, reflecting or suppressing a $TE_{10}$ mode or a $TE_{30}$ mode of the EM waves can be facilitated by employing metallic posts located along a propagation path for the EM waves, as further described herein, such as by, for example, employing an array of metallic posts (e.g., an array of metallic posts 118, an array of metallic posts 418, etc.) located proximate to a centerline 120, 420 of the fundamental mode rejection section (e.g., fundamental mode rejection section 104, fundamental mode rejection section 404, etc.). As a further non-limiting example, exemplary methods 2300 can further comprise selectively suppressing, in the fundamental mode rejection section (e.g., fundamental mode rejection section 104, fundamental mode rejection section 404, etc.), such as, for example, a fundamental mode rejection section that has a width W1 116 selected to suppress the $TE_{30}$ mode of the EM waves in the EM mode transducer, at 2308. In addition, selectively suppressing a $TE_{30}$ mode can further comprise, but are not limited to, selectively suppressing the $TE_{30}$ mode using an array of metallic posts (e.g., an array of metallic posts 118, an array of metallic posts 418, etc.) located proximate to a centerline 120, 420 of the fundamental mode rejection section (e.g., fundamental mode rejection section 104, fundamental mode rejection section 404, etc.). Moreover, at 2310, exemplary methods 2300 can comprise propagating a $TE_{20}$ mode of the EM waves in the EM mode transducer (e.g., EM mode transition or transducer structure 100, 400, 700, 1200, 1700, 1900, 2100, etc.).

Figure 24:
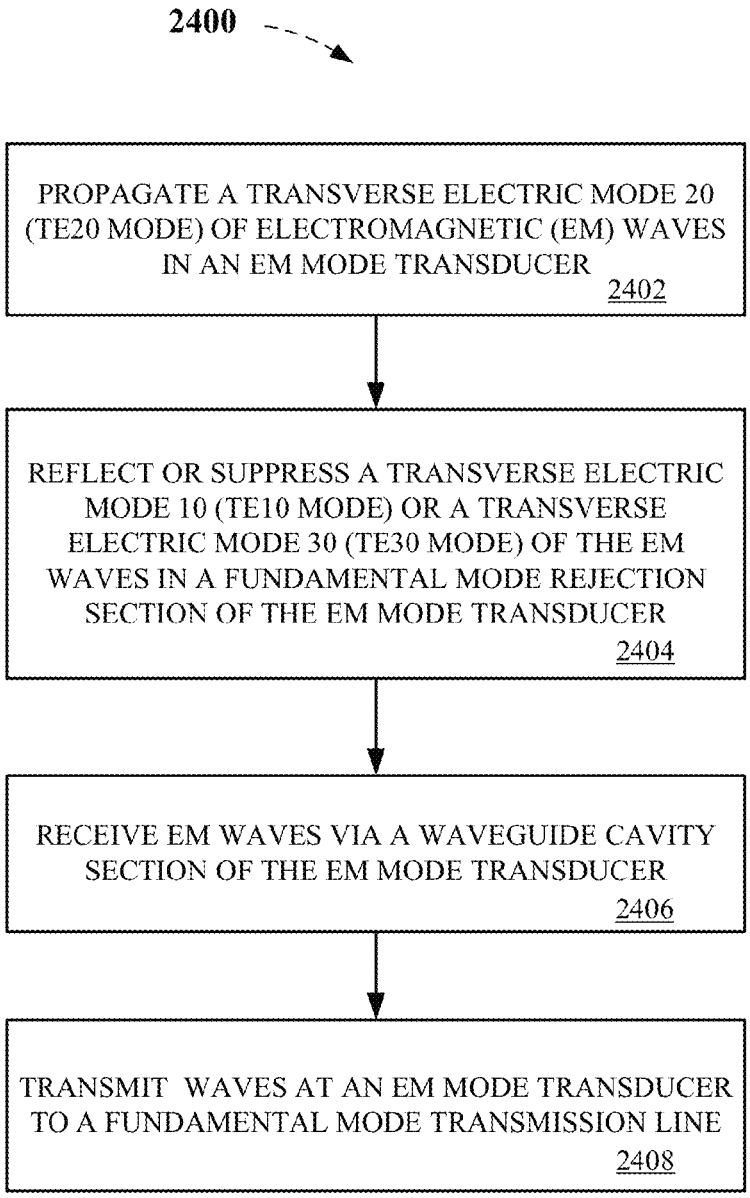
FIG. 24 depicts an exemplary flowchart of further non-limiting methods associated with various non-limiting embodiments of the subject disclosure.

For example, FIG. 24 depicts an exemplary flowchart of non-limiting methods 2400 associated with further non-limiting embodiments of the subject disclosure. Accordingly, FIG. 24 depicts an exemplary flowchart of non-limiting methods 2400 associated with various non-limiting embodiments of the subject disclosure. For example, at 2402, exemplary methods 2400 can comprise propagating a $TE_{20}$ mode of EM waves in an EM mode transducer (e.g., EM mode transition or transducer structure 100, 400, 700, 1200, 1700, 1900, 2100, etc.). For instance, propagating a $TE_{20}$ mode of EM waves in an EM mode transducer can comprise receiving EM waves at an EM mode transition or transducer (e.g., EM mode transition or transducer structure 100, 400, 700, 1200, 1700, 1900, 2100, etc.) comprising a second port (e.g., second port 108, second port 408) located proximate to a fundamental mode rejection section (e.g., fundamental mode rejection section 104, fundamental mode rejection section 404, etc.) and opposite a waveguide cavity section (e.g., over-moded waveguide cavity section 102, over-moded waveguide cavity section 402, etc.). Moreover, in a further non-limiting aspect, the second port can be configured to propagate a $TE_{20}$ mode of EM waves (e.g., EM waves carried in exemplary devices comprising an EM mode transition or transducer) from, for example, a $TE_{20}$ mode waveguide. In various non-limiting embodiments, the $TE_{20}$ mode of EM waves can be propagated to a fundamental mode rejection section (e.g., fundamental mode rejection section 104, fundamental mode rejection section 404, etc.)

of an EM mode transition or transducer (e.g., EM mode transition or transducer structure 100, 400, 700, 1200, 1700, 1900, 2100, etc.).

Exemplary methods 2400 can further comprise one or more of reflecting or suppressing one or more of a $TE_{10}$ mode or a $TE_{30}$ mode of the EM waves in a fundamental mode rejection section (e.g., fundamental mode rejection section 104, fundamental mode rejection section 404, etc.) of the EM mode transducer, at 2404. In a further example, reflecting or suppressing a $TE_{10}$ mode or a $TE_{30}$ mode of the EM waves can be facilitated by employing metallic posts located along a propagation path for the EM waves, as further described herein, such as by, for example, employing an array of metallic posts (e.g., an array of metallic posts 118, an array of metallic posts 418, etc.) located proximate to a centerline 120, 420 of the fundamental mode rejection section (e.g., fundamental mode rejection section 104, fundamental mode rejection section 404, etc.). In addition, exemplary methods 2400 can further comprise selectively suppressing, in the fundamental mode rejection section (e.g., fundamental mode rejection section 104, fundamental mode rejection section 404, etc.), such as, for example, a fundamental mode rejection section that has a width W1 116 selected to suppress the $TE_{30}$ mode of the EM waves in the EM mode transducer, at 2404. Thus, selectively suppressing a $TE_{30}$ mode can further comprise, but are not limited to, selectively suppressing the $TE_{30}$ mode using an array of metallic posts (e.g., an array of metallic posts 118, an array of metallic posts 418, etc.) located proximate to a centerline 120, 420 of the fundamental mode rejection section (e.g., fundamental mode rejection section 104, fundamental mode rejection section 404, etc.). Moreover, the width W1 can be selected to selectively propagate or excite the $TE_{20}$ mode of the EM waves in the EM mode transducer, at 2404. In addition, exemplary methods 2400 can also comprise selectively propagating or exciting the $TE_{20}$ mode of the EM waves, in the fundamental mode rejection section (e.g., fundamental mode rejection section 104, fundamental mode rejection section 404, etc.), such as, for example, a fundamental mode rejection section that has a width W1 116 selected to selectively propagate or excite the $TE_{20}$ mode of the EM waves in the EM mode transducer, at 2404.

As a further non-limiting example, at 2406, exemplary methods 2400 can comprise receiving EM waves from a fundamental mode rejection section (e.g., fundamental mode rejection section 104, fundamental mode rejection section 404, etc.) via an over-moded waveguide cavity section of the EM mode transducer, such as an over-moded waveguide cavity section (e.g., over-moded waveguide cavity section 102, over-moded waveguide cavity section 402, etc.) configured to propagate or excite more than one mode of EM waves in a selected operation frequency band, such as, for example, the X band (e.g., EM waves having a frequency range of about 7 GHz to about 11.2 GHz, etc.), or a subset thereof. In yet another non-limiting aspect, a selected operation frequency band can comprise frequencies in a frequency range of about 8 GHz to about 11.2 GHz. Accordingly, at 2406, exemplary methods 2400 can comprise receiving EM waves via an over-moded waveguide cavity section of the EM mode transducer configured to propagate or excite more than one mode of the EM waves over a selected frequency range (e.g., a selected frequency range of about 8 GHz to about 11.2 GHz, etc.).

In a non-limiting aspect of exemplary methods 2400, at 2406, exemplary methods 2400 can further comprise influencing bandwidth using stepped sidewalls, such as by, for example, employing one or more stepped transitions in a side wall (e.g., step-shaped side wall 704, one or more additional steps 1202 in step-shaped side wall 704, and comprising metallic sidewalls 114, comprising metallic sidewall posts 414, etc.) of the waveguide cavity section. In a further non-limiting aspect of exemplary methods 2400, at 2406, exemplary methods 2400 can further comprise impedance matching using metallic posts in the over-moded waveguide cavity section of the EM mode transducer, such as by, for example, employing a set of impedance matching metallic posts (e.g., a set of impedance matching metallic posts 122, a set of impedance matching metallic posts 422, etc.) located in the over-moded waveguide cavity section (e.g., over-moded waveguide cavity section 102, over-moded waveguide cavity section 402, etc.). In addition, exemplary methods 2400 can comprise transmitting EM waves from an EM mode transition or transducer (e.g., EM mode transition or transducer structure 100, 400, 700, 1200, 1700, 1900, 2100, etc.) to a fundamental mode transmission line, such as a microstrip transmission line (e.g., microstrip transmission line 702, etc.), a strip line, a waveguide (e.g., waveguide 1902, etc.), a coplanar waveguide (e.g., CPW 2102, etc.), or combinations, variations, and/or portions thereof, at 2408.

What has been described above includes examples of the embodiments of the subject disclosure. It is, of course, not possible to describe every conceivable combination of configurations, components, and/or methods for purposes of describing the claimed subject matter, but it is to be appreciated that many further combinations and permutations of the various embodiments are possible. Accordingly, the claimed subject matter is intended to embrace all such alterations, modifications, and variations that fall within the spirit and scope of the appended claims. While specific embodiments and examples are described in subject disclosure for illustrative purposes, various modifications are possible that are considered within the scope of such embodiments and examples, as those skilled in the relevant art can recognize.

In addition, the words "example" or "exemplary" is used herein to mean serving as an example, instance, or illustration. Any aspect or design described herein as "exemplary" is not necessarily to be construed as preferred or advantageous over other aspects or designs. Rather, use of the word, "exemplary," is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

In addition, while an aspect may have been disclosed with respect to only one of several embodiments, such feature may be combined with one or more other features of the other embodiments as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements. Numerical data, such as dimensions, frequencies, and the like, are presented herein in a range format. The range format is used merely for convenience and brevity. The range format is meant to be interpreted flexibly to include not only the numerical values explicitly recited as the limits of the range, but also to include all the individual numerical values or sub-ranges encompassed within the range as if each numerical value and sub-range is explicitly recited. When reported herein, any numerical values are meant to implicitly include the term "about." Values resulting from experimental error that can occur when taking measurements are meant to be included in the numerical values.

What is claimed is:

1. A device, comprising:

an electromagnetic (EM) mode transducer comprising:

a waveguide cavity section, wherein the waveguide cavity section comprises an over-moded waveguide cavity section configured to propagate or excite more than one mode of EM waves over a selected frequency range; and a fundamental mode rejection section, wherein the EM mode transducer is configured as an EM mode transition between a fundamental mode transmission line and a transverse electric mode 20 ($TE_{20}$ mode) waveguide.

2. The device of claim 1, wherein the fundamental mode transmission line comprises at least one of a microstrip transmission line, strip line, a waveguide, or a coplanar waveguide.

3. The device of claim 1, further comprising:

a first port configured to connect the fundamental mode transmission line to the waveguide cavity section of the EM mode transducer.

4. The device of claim 1, wherein the more than one mode of EM waves includes a $TE_{20}$ mode.

5. The device of claim 4, further comprising:

a second port located proximate to the fundamental mode rejection section and opposite the over-moded waveguide cavity section, wherein the second port is configured to propagate the $TE_{20}$ mode of the EM waves to the $TE_{20}$ mode waveguide.

6. The device of claim 1, wherein the over-moded waveguide cavity section comprises at least one stepped transition in a side wall of the over-moded waveguide cavity section.

7. The device of claim 1, wherein the over-moded waveguide cavity section comprises a set of impedance matching metallic posts.

8. The device of claim 1, wherein the fundamental mode rejection section is located proximate to the over-moded waveguide cavity section.

9. The device of claim 1, further comprising:

an array of metallic posts located proximate to a centerline of the fundamental mode rejection section, wherein the array of metallic posts is oriented in a longitudinal direction of the EM mode transducer.

10. The device of claim 1, further comprising:

a set of vias located along the fundamental mode rejection section.

11. The device of claim 1, wherein the over-moded waveguide cavity section is configured in at least one of a rectangular shape, a trapezoidal shape, an arc shape, or a compound structural shape.

12. The device of claim 1, wherein the EM mode transducer is further configured as the EM mode transducer in at least one of a substrate integrated waveguide, a laminated waveguide, or a metal waveguide.

13. The device of claim 1, wherein the EM mode transducer further comprises top and bottom substrate metal sheets supported by at least one of a set of narrow metallic sidewalls or a set of metallic sidewall posts.

14. A method, comprising:

transmitting or receiving electromagnetic (EM) waves at an EM mode transducer to or from a fundamental mode transmission line via an over-moded waveguide cavity section of the EM mode transducer that propagates or excites more than one mode of the EM waves over a selected frequency range; and propagating a transverse electric mode 20 ($TE_{20}$ mode) of the more than one mode of the EM waves in the EM mode transducer.

15. The method of claim 14, wherein the transmitting or receiving to or from the fundamental mode transmission line further comprises transmitting or receiving the EM waves to or from at least one of a microstrip transmission line, strip line, a waveguide, or a coplanar waveguide.

16. The method of claim 14, further comprising:

at least one of influencing bandwidth using stepped sidewalls or impedance matching using metallic posts in the over-moded waveguide cavity section of the EM mode transducer.

17. The method of claim 14, further comprising:

selectively propagating, in a fundamental mode rejection section of the EM mode transducer, the $TE_{20}$ mode of the more than one mode of the EM waves.

18. The method of claim 17, further comprising:

reflecting or suppressing at least one of a transverse electric mode 10 ($TE_{10}$ mode) or transverse electric mode 30 ($TE_{30}$ mode) of the more than one mode of the EM waves in the fundamental mode rejection section of the EM mode transducer.

19. An apparatus, comprising:

means for transmitting or receiving electromagnetic (EM) waves to or from a fundamental mode transmission line wherein the EM waves comprises a transverse electric mode 10 ($TE_{10}$ mode), a transverse electric mode 20 ($TE_{20}$ mode), and a transverse electric mode 30 ($TE_{30}$ mode);

means for suppressing the $TE_{30}$ mode of the EM waves;

means for reflecting or suppressing the $TE_{10}$ mode of the EM waves; and means for controlling propagation of the $TE_{20}$ mode of the EM waves from the fundamental mode transmission line.

20. The apparatus of claim 19, wherein the fundamental mode transmission line comprises at least one of a microstrip transmission line, a strip line, a waveguide, or a coplanar waveguide.

21. The apparatus of claim 19, wherein the means for suppressing the $TE_{30}$ mode has a width selected to suppress the $TE_{30}$ mode of the EM waves.

22. The apparatus of claim 19, further comprising:

means for adjusting bandwidth associated with the means for suppressing.

23. The apparatus of claim 19, further comprising:

means for impedance matching associated with the means for suppressing.

24. The apparatus of claim 19, wherein the means for reflecting or suppressing includes metallic posts located along a propagation path for the EM waves.

* * * * *